US007684732B2

(12) United States Patent
Fujita et al.

(10) Patent No.: US 7,684,732 B2
(45) Date of Patent: Mar. 23, 2010

(54) PROCESS UNIT AND IMAGE FORMING APPARATUS INCLUDING THE SAME

(75) Inventors: Tetsumaru Fujita, Nishinomiya (JP); Yoshio Sakagawa, Ashiya (JP); Yuji Nagatomo, Minoo (JP)

(73) Assignee: Ricoh Company, Ltd., Tokyo (JP)

( * ) Notice: Subject to any disclaimer, the term of this patent is extended or adjusted under 35 U.S.C. 154(b) by 233 days.

(21) Appl. No.: 11/956,901

(22) Filed: Dec. 14, 2007

(65) Prior Publication Data

US 2008/0152385 A1 Jun. 26, 2008

(30) Foreign Application Priority Data

Dec. 22, 2006 (JP) ..... 2006-345332
Jul. 10, 2007 (JP) ..... 2007-180555

(51) Int. Cl.
*G03G 21/00* (2006.01)

(52) U.S. Cl. ..... 399/129; 399/128

(58) Field of Classification Search ..... 399/111, 399/128, 129, 149, 150, 174, 175, 176
See application file for complete search history.

(56) References Cited

U.S. PATENT DOCUMENTS 5,321,471 A * 6/1994 Ito et al. ..... 399/129
5,666,596 A * 9/1997 Yoo ..... 399/111
5,751,801 A * 5/1998 Murata et al. ..... 399/176
6,754,461 B2 * 6/2004 Hoshi et al. ..... 399/129
6,963,707 B2 * 11/2005 Kinoshita et al. ..... 399/129
7,146,123 B2 * 12/2006 Kidaka ..... 399/129
7,469,116 B2 * 12/2008 Kitajima ..... 399/129
2007/0065179 A1 3/2007 Fujita
2007/0172259 A1 7/2007 Fujita
2007/0280735 A1 12/2007 Nagatomo et al.

FOREIGN PATENT DOCUMENTS

JP 2005-62737 3/2005

OTHER PUBLICATIONS

U.S. Appl. No. 12/204,083, filed Sep. 4, 2008, Fujita, et al.
U.S. Appl. No. 12/187,021, filed Aug. 6, 2008, Shono, et al.

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

An image forming apparatus includes at least a latent image carrier, a latent image forming mechanism, a developing mechanism and a charger. The latent image carrier bears a latent image. The latent image forming mechanism forms the latent image on the latent image carrier. The developing mechanism develops the latent image on the latent image carrier with toner. The charger includes a conductive member supplied with a bias voltage while contacting a surface of the latent image carrier, and charges at least one of the surface of the latent image carrier and a toner adhering to the surface thereof through the conductive member. A tensile strength of the conductive member at break is no less than 10 MPa and no more than 40 MPa, and a contact pressure between the conductive member and the latent image carrier is no less than 4 $kN/m^2$ and no more than 15 $kN/m^2$.

13 Claims, 10 Drawing Sheets

PROCESS UNIT AND IMAGE FORMING APPARATUS INCLUDING THE SAME

CROSS-REFERENCE TO RELATED APPLICATIONS

The present patent application is based on and claims priority under 35 U.S.C. §119 from Japanese Patent Application Nos. 2006-345332, filed on Dec. 22, 2006, and 2007-180555, filed on Jul. 10, 2007 in the Japan Patent Office, the entire contents of each of which are incorporated herein by reference.

BACKGROUND OF THE INVENTION

1. Field of the Invention

Exemplary aspects of the present invention generally relate to an image forming apparatus such as a copier, a facsimile, and an image forming apparatus, and more particularly, to an image forming apparatus that includes a process unit that utilizes a charger for charging either a surface of a latent image carrier, toner on the surface of the latent image carrier, or both.

2. Discussion of the Background

Generally, an image forming apparatus employing electrophotography forms an image in the following manner: A latent image carrier such as a photoreceptor is evenly charged and exposed so as to form an electrostatic latent image. A developing unit develops the electrostatic latent image to produce a toner image. Subsequently, the toner image formed during development is transferred to a recording medium such as a transfer sheet or the like from the latent image carrier, or the toner image is transferred to the recording medium through an intermediate transfer member.

Such an image forming apparatus uses a charger that applies a charging bias to a charging member such as a charging roller or the like, which is conductive and abuts a surface of the latent image carrier. Accordingly, discharge is generated between the latent image carrier and the charging member, thereby evenly charging the surface of the latent image carrier.

Furthermore, a charger that performs secondary charging is also known. For example, according to JP-2005-62737-A, such a charger includes a charging roller and a scorotron charger serving as a main charger that evenly charges the latent image carrier as well as a secondary charging member to which a secondary charging bias is applied. The secondary charging member comes into contact with a place on a continuous moving surface of the latent image carrier that has passed through a transfer process before being charged by the main charger. Discharge or charge injection from the secondary charging member secondarily charges the surface of the latent image carrier before the main charger evenly charges the latent image carrier. Furthermore, residual toner adhering to the surface after transfer (transfer residual toner) is charged to a normal charge polarity.

As a result of all the above-described operations, uneven charging of the latent image carrier can be suppressed. In addition, contamination of the developing region due to weakly charged toner and/or oppositely charged toner being re-transported to the charging region can be reduced, if not prevented entirely. Moreover, contamination of the charging member due to the weakly charged toner and/or the oppositely charged toner being transferred to the charging member can also be prevented.

However, when the transfer residual toner firmly adheres to the conductive member serving as the charging member abutting the latent image carrier and to the secondary charging member, such a charger has a drawback in that the transfer residual toner and/or the latent image carrier surface intervenes between the discharge and/or the charge injection between the charging member and the secondary charging member. Consequently, the main charging and/or the secondary charging may not be performed well, thereby causing uneven charging. Furthermore, the transfer residual toner may not be appropriately charged, causing contamination of the surface of the latent image carrier. Contamination herein refers to a phenomenon in which the toner adheres to the surface (the evenly charged portion) of the latent image carrier.

SUMMARY

In view of the foregoing, exemplary embodiments of the present invention provide a process unit that reduces or prevents uneven charging and contamination due to toner adhering to a conductive member for an extended period of time, and provide an image forming apparatus using the process unit.

In one exemplary embodiment, an image forming apparatus includes at least a latent image carrier, a latent image forming mechanism, a developing mechanism, and a charger. The latent image carrier bears a latent image. The latent image forming mechanism forms the latent image on the latent image carrier. The developing mechanism develops the latent image on the latent image carrier with toner into a toner image. The charger includes a conductive member supplied with a bias voltage while contacting a surface of the latent image carrier, and charges at least one of the surface of the latent image carrier and a toner adhering to the surface thereof through the conductive member. A tensile strength of the conductive member at break is no less than 10 MPa and no more than 40 MPa, and a contact pressure between the conductive member and the latent image carrier is no less than 4 $kN/m^2$ and no more than 15 $kN/m^2$.

Another exemplary embodiment provides a process unit that includes a holder that is detachably mountable in an image forming apparatus. The holder holds at least one of a latent image carrier and a charger. The image forming apparatus includes at least a latent image carrier, a latent image forming mechanism, a developing mechanism, and a charger. The latent image carrier bears a latent image. The latent image forming mechanism forms the latent image on the latent image carrier. The developing mechanism develops the latent image on the latent image carrier with toner. The charger includes a conductive member supplied with a bias voltage while contacting a surface of the latent image carrier, and charges at least one of the surface of the latent image carrier and a toner adhering to the surface thereof through the conductive member. A tensile strength of the conductive member at break is no less than 10 MPa and no more than 40 MPa, and a contact pressure between the conductive member and the latent image carrier is no less than 4 $kN/m^2$ and no more than 15 kN $m^2$.

Yet another exemplary embodiment provides an image forming apparatus including means for bearing a latent image; means for forming the latent image on the latent image carrier, means for developing the latent image on the latent image carrier with toner; and means for charging at least the surface of the latent image carrier and a toner adhering to the surface thereof through the conductive member, including a conductive member supplied with a bias while contacting a surface of the latent image carrier. A tensile strength of the conductive member at break is no less than 10 MPa and no more than 40 MPa, and a contact pressure between the conductive member and the latent image carrier is no less than 4 $kN/m^2$ and no more than 15 kN $m^2$.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
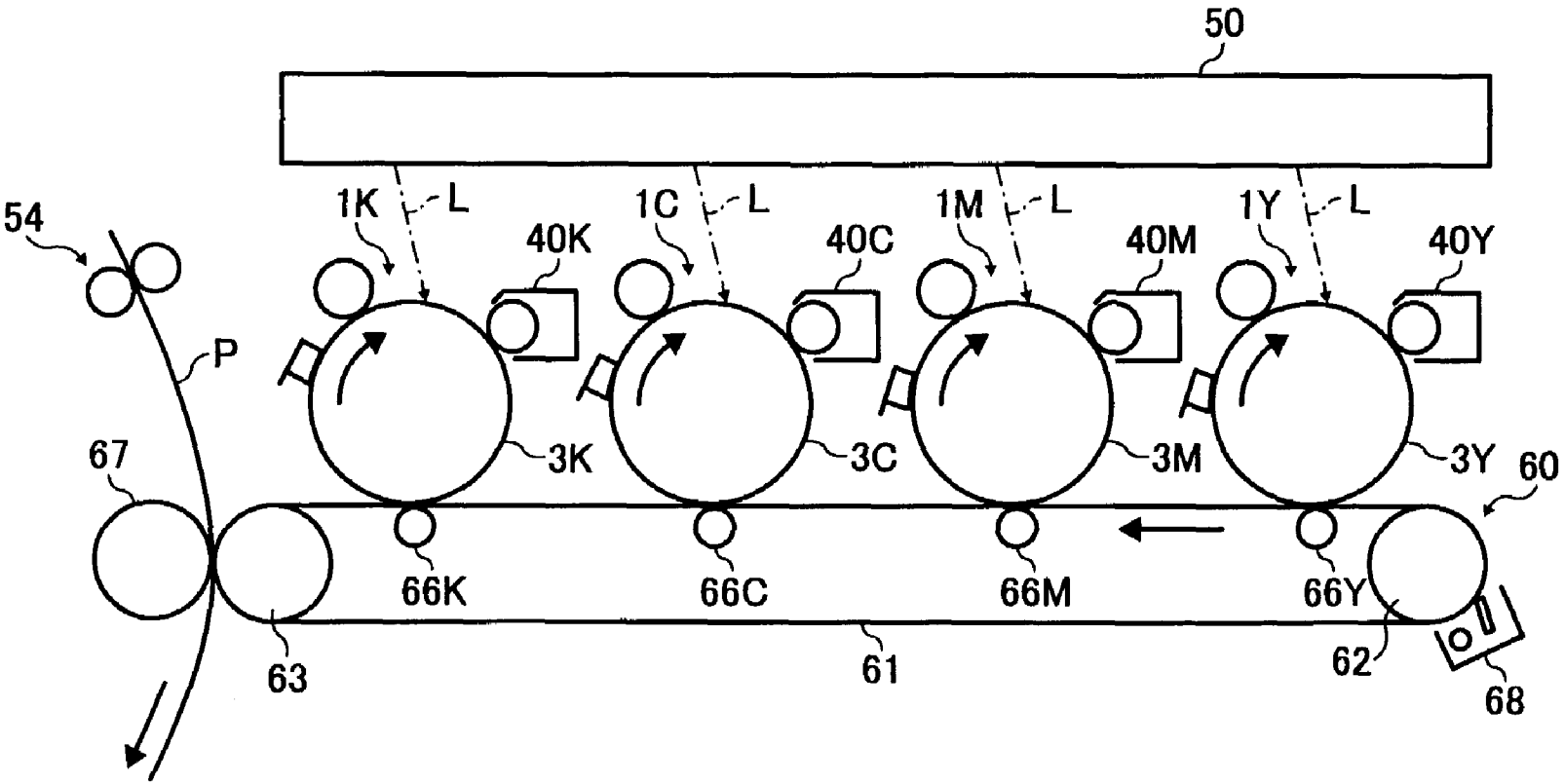
FIG. 1 is a schematic diagram illustrating an image forming apparatus, for example, an image forming apparatus, according to an exemplary embodiment of the present invention.

It will be understood that if an element or layer is referred to as being "on," "against," "connected to" or "coupled to" another element or layer, then it can be directly on, against connected or coupled to the other element or layer, or intervening elements or layers may be present.

In contrast, if an element is referred to as being "directly on", "directly connected to" or "directly coupled to" another element or layer, then there are no intervening elements or layers present. Like numbers refer to like elements throughout.

As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures.

It will be understood that the spatially relative terms are intended to encompass different orientations of the device in use or operation in addition to the orientation depicted in the figures.

For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms.

These terms are used only to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Exemplary embodiments of the present invention are now described below with reference to the accompanying drawings.

In a later-described comparative example, exemplary embodiment, and exemplary variation, for the sake of simplicity the same reference numerals will be given to identical constituent elements such as parts and materials having the same functions and redundant descriptions thereof omitted unless otherwise stated.

Typically, but not necessarily, paper is the medium from which is made a sheet on which an image is to be formed. It should be noted, however, that other printable media are available in sheets, and accordingly their use here is included.

Thus, solely for simplicity, although this Detailed Description section refers to paper, sheets thereof, paper feeder, etc., it should be understood that the sheets, etc., are not limited only to paper but includes other printable media as well.

Referring now to the drawings, wherein like reference numerals designate identical or corresponding parts throughout the several views thereof, and initially to FIG. 1, an image forming apparatus, for example, a color laser printer of an electrophotographic type (hereinafter referred to as image forming apparatus) according to an exemplary embodiment of the present invention is described.

Referring to FIG. 1, there is provided a schematic diagram illustrating a basic structure of the image forming apparatus according to one exemplary embodiment of the present invention.

As shown in FIG. 1, the image forming apparatus includes at least four process units 1M, 1C, 1Y and 1K which form toner images of magenta (M), cyan (C), yellow (Y) and black (K), respectively, an optical writing unit 50, a pair of registration rollers 54, a transfer unit 60 and so forth. The letter symbols M, C, Y, and K refers to different colors of magenta, cyan, yellow, and black, respectively.

The optical writing unit 50 serving as a latent image forming mechanism includes at least a light source consisting of four laser diodes corresponding to yellow, magenta, cyan, and black; a regular-hexahedron polygon mirror; a polygon motor that rotatively drives the polygon mirror; an f-θ lens, a lens, a reflective mirror, and so forth.

A laser beam L emitted from each of the laser diodes is reflected by one of the mirror surfaces of the polygon mirror and deflected along with the rotation of the polygon mirror. Accordingly, the laser beam L reaches one of four later-described photoreceptors. The surface of the four photoreceptors is optically scanned with the respective laser beams L emitted from the laser diodes.

The process units 1Y, 1M, 1C, and 1K at least include drum-type photoreceptors 3Y, 3M, 3C, and 3K each serving as a latent image carrier, respectively. The process units 1Y, 1M, 1C, and 1K include developing units 40Y, 40M, 40C and 40K each serving as a developing mechanism corresponding to the photoreceptors 3Y, 3M, 3C, and 3K.

The photoreceptors 3Y, 3M, 3C, and 3K are rotatively driven in a clockwise direction shown by an arrow direction in FIG. 1 at a predetermined linear velocity by a driving mechanism, not shown. The photoreceptors 3Y, 3M, 3C, and 3K are optically scanned in the dark by the optical writing unit 50 which emits the laser beams L modulated based on image information transmitted from a personal computer or the like, not shown.

Accordingly, the photoreceptors 3Y, 3M, 3C, and 3K bear electrostatic latent images of yellow, magenta, cyan and black, respectively.

Figure 2:
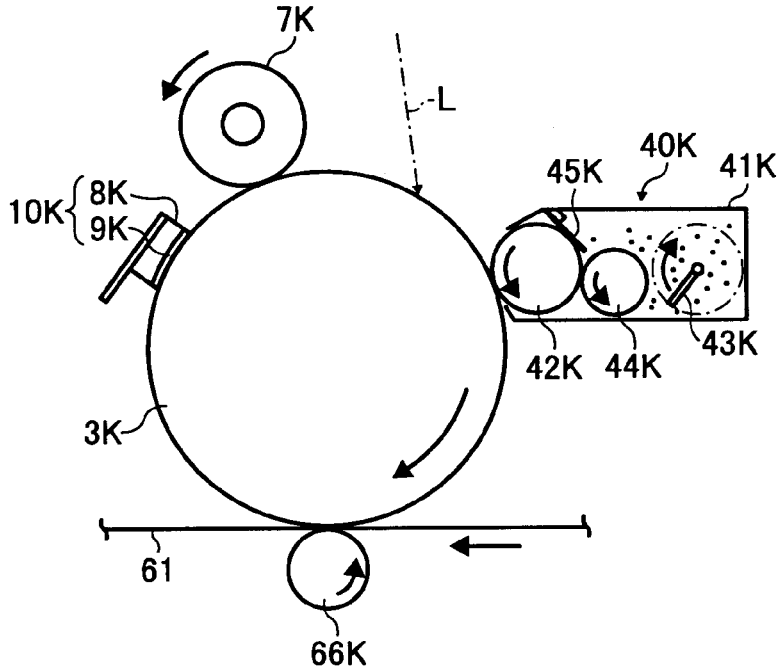
FIG. 2 is an enlarged view illustrating a process unit for black and an intermediate transfer belt of the image forming apparatus of FIG. 1.

Referring now to FIG. 2, there is provided an enlarged view illustrating the process unit 1K as a representative example among the four process units 1Y, 1M, 1C, and 1K. FIG. 2 also illustrates an intermediate transfer belt 61 of the transfer unit 60.

In FIG. 2, the process unit 1K holds at least the photoreceptor 3K, a charger, a discharging lamp, not shown, and the developing unit 40K serving as a developing mechanism together in a common casing or a holding member detachable from the image forming apparatus.

The photoreceptor 3K for black serving as a device to be charged and a latent image carrier is formed of a conductive base made of an aluminum tube having a surface covered with a photosensitive layer made of a negatively charged organic photoconductor (OPC). The diameter of the photoreceptor 3K is approximately 24 mm.

As shown in FIG. 2, the photoreceptor 3K is rotatively driven in the clockwise direction shown by an arrow at a predetermined linear velocity by a driving mechanism, not shown. Accordingly, the surface of the photoreceptor 3K sequentially passes through a later-described first transfer nip, that is, a contact position with the intermediate transfer belt 61, a secondary charging nip, a charging nip, an optical writing position and the developing region.

The developing unit 40K includes a developing roller 42K. A portion of a peripheral surface of the developing roller 42K is exposed from an opening provided to a casing 41K. The developing roller 42K serving as a developer carrier includes shafts projecting from both ends of the developing roller 42K in a longitudinal direction. The shafts are each rotatively held by a shaft bearing, not shown.

The casing 41K includes a black toner (hereinafter referred to as toner K). The toner K is transported from the right to the left in FIG. 2 by an agitator 43K which is rotatively driven.

As shown in FIG. 2, on the left of the agitator 43K is provided a toner supply roller 44K rotatively driven by a driving mechanism, not shown, in a counter-clockwise direction shown by an arrow.

The roller portion of the toner supply roller 44K includes an elastic foam member such as a sponge so as to be able to capture the toner K from the agitator 43K. The captured toner K is supplied to the developing roller 42K at a position where the toner supply roller 44K and the developing roller 42K come into contact.

A thickness of the toner K borne on the surface of the developing roller 42K is regulated when the toner K passes through a place where the developing roller 42K comes into contact with a regulating blade 45 along with the rotation of the developing roller 42K in the counter-clockwise direction. The toner K is frictionally charged. Subsequently, the toner K is transported to the developing region facing the photoreceptor 3K.

The developing roller 42K is supplied with a negative developing bias output from a power source, not shown. In the developing region, a developing potential which causes the negative toner K to electrostatically move from the developing roller 42K to the latent image side, acts on a place between the developing roller 42K and an electrostatic latent image of the photoreceptor 3K.

A non-developing potential which causes the negative toner K to electrostatically move from the surface of the photoreceptor 3K to the developing roller 42K acts on a place between the developing roller 42K and the surface of the photoreceptor 3K subjected to be charged.

The developing potential causes the toner K on the developing roller 42K to separate from the developing roller 42K and to transfer to the electrostatic latent image on the photoreceptor 3K.

Accordingly, the electrostatic latent image on the photoreceptor 3K is developed as a toner image of black (hereinafter referred to as toner image K).

According to the exemplary embodiment, a mono-component developing method using a mono-component developer including the toner K as a primary component is employed in the developing unit 40K. However, a two-component developing method using the toner K and magnetic carriers may be employed in the developing unit 40K.

The toner image K developed in the developing region is transported to a place where the photoreceptor 3K and the intermediate transfer belt 61 are in contact with each other, that is, a primary transfer nip, along with the rotation of the photoreceptor 3K. At the primary transfer nip, the toner image K is intermediately transferred onto the intermediate transfer belt 61.

After passing through the primary transfer nip, the residual toner that has not been transferred to the intermediate transfer belt 61 adheres to the surface of the photoreceptor 3K. Handling of the transfer residual toner is described later.

In FIG. 2, the charger includes a charging roller 7K, a secondary charging member 10K, and so forth. The charging roller 7K is rotatively driven in the counter-clockwise direction shown by an arrow in FIG. 2 and abuts the photoreceptor 3K to form a charging nip. The secondary charging member 10K abuts the photoreceptor 3K to form a secondary charging nip.

The charging roller 7K includes a rotary shaft member made of metal having a peripheral surface covered with a roller member made of a conductive and elastic material such as conductive rubber.

The rotary shaft member is supplied with a charging bias by a charging bias supply mechanism equipped at least with a power source, not shown. Through application of the charging bias discharge occurs between the charging roller 7K and the photoreceptor 3K, thereby uniformly charging the surface of the photoreceptor 3K to the same polarity as the charging polarity of the toner.

The secondary charging member 10K includes an elastic portion 8K. The elastic portion 8K is formed of an elastic material such as a sponge or the like having a surface covered with a conductive sheet 9K made of a conductive material.

While being pressed against the photoreceptor 3K by a holder member, the conductive sheet 9K of the secondary charging member 10K abuts a portion of the peripheral surface of the photoreceptor 3K after passing through the primary transfer nip before advancing to the charging nip.

The conductive sheet 9K is supplied with a direct current voltage having the same polarity as the charging polarity of the toner or a secondary charging bias including a direct current voltage superimposed on an alternating current voltage.

The transfer residual toner adhering to the surface of the photoreceptor 3K after passing through the primary transfer nip may include a toner charged to a normal charging polarity, a weakly charged toner having a normal charging polarity and insufficiently charged, and an oppositely charged toner which is charged to an opposite polarity.

Such a transfer residual toner advances to the secondary charging nip along with the rotation of the photoreceptor 3K. Subsequently, discharge between the secondary charging member 10K and the photoreceptor 3K or charge injection from the secondary charging member 10K causes the oppositely charged toner in the transfer residual toner to be adequately charged to a negative polarity which is a normal polarity. The weakly charged toner in the transfer residual toner is also adequately charged to a negative polarity due to discharge or charge injection.

The optical writing unit 50 optically scans the surface of the photoreceptor 3K uniformly charged in the charging nip so that an electrostatic latent image of black is formed thereon. Subsequently, the developing unit 40K develops the electrostatic latent image of black to form the toner image of black.

As described above, the secondary charging member 10K adequately charges the weakly charged toner and the oppositely charged toner to the negative polarity, which is the normal polarity. Accordingly, contamination of the charging roller 7K by the toner, uneven charging of the photoreceptor 3K, contamination of the surface of the photoreceptor 3K and a residual image are all prevented.

Specifically, the charging bias to be applied to the charging roller 7K includes the direct current voltage of the negative polarity or an alternating current voltage superimposed on the direct current voltage. The charging roller 7K is supplied with the charging bias so that the charging roller 7K is relatively charged to a negative polarity.

In the charging nip, the photoreceptor 3K is charged to the negative polarity. The negative polarity of the photoreceptor 3K is relatively smaller than the negative polarity of the charging roller 7K.

Consequently, the weakly charged toner and/or the oppositely charged toner in the transfer residual toner is most likely transferred from the surface of the photoreceptor 3K to the surface of the charging roller 7K in the charging nip, and is easily accumulated on the roller surface.

In view of the above, the weakly charged toner and the oppositely charged toner are adequately charged to the negative polarity at a position further upstream than the charging nip. Accordingly, the amount of the toner transferred from the photoreceptor 3K to the charging roller 7K can be reduced at the charging nip and/or at a nip entrance, thereby making it possible to reduce, if not prevent, contamination of the charging roller 7K by the toner.

Furthermore, uneven charging of the photoreceptor 3K can be prevented when discharge and/or charge injection is not performed well, and creation of a residual image at a solid portion due to such uneven charging can be suppressed.

Where discharge is generated between the conductive sheet 9K of the secondary charging member 10K and the photoreceptor 3K, the discharge causes the photoreceptor 3K to be secondarily charged before the charging roller 7K performs the main charging on the photoreceptor 3K. Accordingly, uneven charging can be reduced, if not prevented.

When the weakly charged toner and/or the oppositely charged toner which has not been transferred to the charging roller 7K is transported to the developing region, the surface of the photoreceptor 3K is likely to be contaminated, because the relation between the potential of the surface of the photoreceptor 3K and the potential (developing bias) of the developing roller 42K prevents the weakly charged toner and/or the oppositely charged toner from transferring to the developing roller 42K at the developing region. Consequently, the weakly charged toner and/or the oppositely charged toner easily accumulates on the surface of the photoreceptor 3K.

When the secondary charging member 10K adequately charges the weakly charged toner and/or the oppositely charged toner to the negative polarity, contamination of the surface of the photoreceptor 3K can be reduced, if not prevented.

Furthermore, contamination of the charging roller 7K with the toner that occurs when the weakly charged toner and/or the oppositely charged toner is transferred to the charging roller 7K can be reduced if not prevented. Uneven charging that occurs when discharge is not well performed at the contaminated portion can be also reduced, if not prevented. Creation of a residual image at a solid portion due to the uneven charging can be suppressed.

The foregoing description pertains to the process unit 1K for black. However, the structure of other process units 1Y, 1M, and 1C is similar to, if not the same as, that of the process unit K. Thus, a description thereof is omitted herein.

The process units 1Y, 1M, 1C, and 1K are a cleanerless type process unit. The cleanerless type process unit recovers the transfer residual toner adhering to the latent image carrier such as the photoreceptor 3K without using a dedicated device for cleaning and recovering the transfer residual toner, and performs an image forming process on the latent image carrier.

The dedicated device for cleaning and recovering refers to a recycling mechanism that separates the transfer residual toner from the image carrier, and transports the transfer residual toner to a waste toner container and the developing unit without having the transfer residual toner to adhere to the latent image carrier.

A cleaning blade for scraping the transfer residual toner from the latent image carrier is also included in the dedicated device.

A detailed description will now be given of a cleanerless type process unit.

The cleanerless type itself can be broadly classified into dispersion types, temporary capture types, and combination types.

In the dispersion type, a dispersing member such as a brush which brushes the latent image carrier is employed. When the dispersing member scrapes the residual image formed of the transfer residual toner on the surface of the latent image carrier after transfer, the toner in the residual image is dispersed and adhesion between the toner and the latent image carrier is weakened so that it is easy to collect the transfer residual toner in the developing region in a next process.

Subsequently, at the developing region where the developing member such as a developing sleeve and the developing roller faces the latent image carrier, the transfer residual toner on the latent image carrier is electrostatically transferred to the developing member, thus returning the transfer residual toner to the developing unit.

Prior to the recovery, the transfer residual toner passes through the optical writing position for writing the latent image. However, when the amount of the transfer residual toner is relatively small, there is no adverse effect on the latent image writing.

When the transfer residual image contains the oppositely charged toner charged to an opposite polarity to the normal polarity, the transfer residual toner is not recovered to the developing member and the surface of the photoreceptor remains contaminated.

Therefore, in order to suppress contamination by the oppositely charged toner, preferably, a toner charging mechanism that charges the transfer residual toner on the latent image carrier to the normal polarity is provided at a position between the transfer position, for example, the primary transfer nip, and the dispersing member, or between the dispersing position and the developing region.

The dispersing member may be a fixed brush, a brush roller, a roller member, for example, a charging roller, or the like. The fixed brush may include a plurality of brush fibers made of conductive fibers attached to a metal plate or a casing. The brush roller may include a plurality of brush fibers provided to a metal rotary shaft member in an erect manner. The roller member, for example, the charging roller, may include a roller portion made of a conductive sponge or any other suitable material.

One advantage of the fixed brush is that the fixed brush can be structured with relatively few brush fibers, and is thus cost effective. However, when using the fixed brush as a charging member for uniformly charging the latent image carrier, charging uniformity may not be sufficient.

By contrast, one advantage of the brush roller is that it can provide sufficient charging uniformity.

In the temporary capture type of the cleanerless type, a capture member, for example, a rotary brush member that continuously moves while contacting the surface of the latent image carrier, temporarily captures the transfer residual toner on the latent image carrier.

After a print job is completed or between print jobs, the transfer residual toner on the capture member is released so that the toner is transferred to the latent image carrier. Subsequently, the toner is electrostatically transferred to the developing member such as the developing roller and is recovered in the developing unit.

In the dispersion type, when the amount of the transfer residual toner is substantially large when forming a solid image or after paper jams, there is a possibility that the amount of the transfer residual toner exceeds the recovery ability relative to the developing member, causing an abnormal image to be formed.

On the other hand, in the temporary-capture type, the capture member recovers the transfer residual toner captured by the capture member little by little to the developing member, thereby suppressing abnormal imaging.

The combination cleanerless type is a combination of the dispersion type and the temporary-capture type, and may have the best performance of all three types.

In particular, the combination type uses the rotary brush member or the like as the dispersing member and the capture member that contacts the latent image carrier. When the direct current voltage is applied to the rotary brush member or the like, the rotary brush or the like can serve as the dispersing member while also serving as the capture member by switching the bias voltage from the direct current voltage to the superimposed voltage.

According to one exemplary embodiment, the image forming apparatus uses the dispersion type of the cleanerless type. While rotatively driven in the clockwise direction at a predetermined linear velocity, the photoreceptor 3K comes into contact with a front surface of the intermediate transfer belt 61, thereby forming the primary transfer nip for black.

The secondary charging member 10K and/or the charging roller 7K serving as the dispersing member scrapes the transfer residual toner on the photoreceptor 3K. Accordingly, the adhesion between the transfer residual toner and the photoreceptor 3K is reduced. Subsequently, in the developing region, the transfer residual toner on the photoreceptor 3K is electrostatically transferred to the developing roller 42K of the developing unit 40K and is recovered.

At this time, when the transfer residual toner includes substantial amounts of the weakly charged toner and/or the oppositely charged toner, the weakly charged toner and/or the oppositely charged toner may not be recovered onto the developing roller 42K, leaving the surface of the photoreceptor contaminated.

As shown in FIG. 1, at the bottom of the process units 1Y, 1M, 1C, and 1K is provided the transfer unit 60. The transfer unit 60 includes at least the endless intermediate transfer belt 61 stretched around a plurality of spanning rollers and moving in a continuous loop in the counter-clockwise direction shown by an arrow in FIG. 1.

The plurality of the spanning rollers includes at least a driven roller 62, a driving roller 62, and four primary transfer bias rollers 66Y, 66M, 66C, and 66K.

The driven roller 62, the driving roller 63, and the primary transfer bias rollers 66Y, 66M, 66C, and 66K are in contact with a rear surface or an inner loop surface of the intermediate transfer belt 61.

The primary transfer bias rollers 66Y, 66M, 66C, and 66K each consist of a metal core covered with an elastic member such as a sponge and are pressed against the photoreceptors 3Y, 3M, 3C, and 3K, respectively.

The intermediate transfer belt 61 is nipped between the primary transfer bias rollers 66Y, 66M, 66C and 66K, and the photoreceptors 3Y, 3M, 3C, and 3K. Accordingly, the photoreceptors 3Y, 3M, 3C, and 3K, and the front surface of the primary transfer bias rollers 66Y, 66M, 66C and 66K are in contact with each other for a predetermined length in the belt direction of movement, thereby forming four primary transfer nips.

The metal core of each of the primary transfer bias rollers 66Y, 66M, 66C and 66K is supplied with the primary transfer bias which is under a constant current control by a transfer bias power source (not shown).

Accordingly, the rear surface of the intermediate transfer belt 61 is provided with a transfer charge through the primary transfer bias rollers 66Y, 66M, 66C and 66K, thereby forming a transfer electrical field between the intermediate transfer belt 61 and the photoreceptors 3Y, 3M, 3C, and 3K at each of the primary transfer nips.

According to the exemplary embodiment, the primary transfer bias rollers 66Y, 66M, 66C and 66K serve as the primary transfer mechanism. However, instead of using the rollers, the primary transfer mechanism may be of a brush or a blade or any other suitable material. Furthermore, a transfer charger may be utilized.

The toner images of yellow, magenta, cyan and black formed on the photoreceptors 3Y, 3M, 3C, and 3K, respectively, are primarily transferred onto the intermediate transfer belt 61 on one another at the primary transfer nip of each respective color. Accordingly, a four-color overlapped toner image (hereinafter referred to as four-color toner image) is formed on the intermediate transfer belt 61.

A secondary transfer bias roller 67 is pressed against the front surface of the intermediate transfer belt 61 at a position where the secondary transfer bias roller 67 comes into contact with the driving roller 63. Accordingly, a secondary transfer nip is formed.

The secondary transfer bias roller 67 is supplied with the secondary transfer bias by a voltage application device including a power source and/or wires (not shown).

Accordingly, a secondary transfer electrical field is formed between the secondary transfer bias roller 67 and the driving roller 63 connected to ground. The four-color toner image formed on the intermediate transfer belt 61 advances to the secondary transfer nip along with the belt movement of the endless loop.

The image forming apparatus according to the exemplary embodiment includes a sheet feed cassette (not shown). A plurality of recording sheets P is stacked on one another and stored in a form of a bundle. A top sheet of the recording sheets P is sent to a sheet feed path with a predetermined timing. The recording sheet P being sent is nipped in a registration nip between a pair of registration rollers 54 disposed at the end of the sheet feed path.

The pair of the registration rollers 54 is rotatively driven so that the recording sheet P sent from the sheet feed cassette is nipped by the registration nip. Immediately after nipping the tip of the recording sheet P, the rotary motion of the rollers is stopped.

The recording sheet P is fed to the secondary transfer nip in synchronization with the four-color toner image on the intermediate transfer belt 61.

In the secondary transfer nip the secondary electrical field and the nip pressure cause the four-color toner image on the intermediate transfer belt 61 to secondarily transfer onto the recording sheet P. Therefore, with the background color of the recording sheet P, that is, white, a full-color image is formed.

Accordingly, the recording sheet P on which the full-color image is formed is discharged from the secondary transfer nip. Subsequently, the recording sheet P is sent to the fixing unit so that the full-color image is fixed.

A secondary transfer residual toner adhering to the surface of the intermediate transfer belt 61 after passing through the secondary transfer nip is removed by a belt cleaner 68.

The image forming apparatus according to the exemplary embodiment uses negatively-charged toners of yellow, magenta, cyan, and black. The photoreceptors 3Y, 3M, 3C, and 3K are each uniformly charged to the negative polarity by the respective chargers.

Subsequently, the negative potential of the electrostatic latent image formed by the optical scanning is attenuated less than that of the surfaces of the photoreceptors.

The image forming apparatus according to the exemplary embodiment employs a negative-positive development method in which the negatively charged toner adheres to the electrostatic latent image with attenuated potential.

Next, a description will be given of characteristics of the image forming apparatus of the exemplary embodiment.

The inventors of the present invention performed experiments using a test machine having the same structure as that of the image forming apparatus of the exemplary embodiment shown in FIG. 1. Using the test machine the following test printing was performed.

In the test printing, the charging bias including a direct current voltage of −1100 V was applied to the charging roller 7K of the process unit 1K.

The secondary charging bias including a direct current voltage of a negative polarity was applied to the conductive sheet 9K.

When the test printing was performed under the above-described conditions, the secondary charging by the conductive sheet 9K caused the weakly charged toner and the oppositely charged toner in the transfer residual toner to be negatively charged, that is, the transfer residual toner was charged to the normal polarity. Accordingly, contamination of the surface of the photoreceptor was suppressed.

Furthermore, prior to the main charging performed by the charging roller 7K, the photoreceptor 3K was secondarily charged with the secondary charging bias less than the charging bias. Accordingly, uneven charging was suppressed.

The experiment was performed such that printing was performed under a first condition (Condition 1), and subsequently, printing was performed under a second condition (Condition 2).

[Condition 1]

While the secondary charging bias of −1500 V was applied to the conductive sheet 9K pressed against the photoreceptor 3K at a pressure of 1 $kN/m^2$, a monochrome solid image was continuously printed on 500 sheets of A4 size paper. An image-area ratio was 100%.

After the continuous printing, a significant amount of the transfer residual toner was confirmed between the conductive sheet 9K of the process unit 1K and the photoreceptor 3K.

[Condition 2]

Initially, the contact pressure between the conductive sheet 9K and the photoreceptor 3K was set to a given value. While the same amount of the charging bias as that of Condition 1 was applied to the conductive sheet 9K, and a direct current voltage of −700 was applied as the secondary charging bias, a monochrome two-by-two halftone image was continuously printed on 500 sheets of A4 size paper. The image-area ratio was 5%.

The above-described test printing was performed on a plurality of the conductive sheets 9K of different types having different tensile strengths at break while varying the contact pressure between the conductive sheet 9K and the photoreceptor 3K in the second condition.

The tensile strengths of the conductive sheet 9K at break were measured in accordance with JIS-K-6897.

The contact pressure between the conductive sheet 9 and the photoreceptor 3K was measured by attaching a load converter to a test device, and the secondary charging member 10K of the image forming apparatus of the exemplary embodiment was pressed against the test device under the same condition as the exemplary embodiment. The load against the test member was then measured. The contact pressure per unit area was then calculated based on the load and the area of contact of the conductive sheet 9K with the test device.

A particle diameter of the toner used in the experiments was regulated to 8.5 μm through a pulverization method. An external additive was added thereto.

When printing the monochrome two-by-two halftone image, the each photoreceptor was rotatively driven at a velocity of 120 mm/sec.

For the charging brush roller of each color (for example, 7K) a roller including a metal rotary shaft having a diameter of 6 mm covered with a conductive rubber layer was used. A diameter ϕ of the roller was 10 mm.

For the conductive sheet 9K of the secondary charging member 10K, different types of the conductive sheets 9 with different tensile strengths at break were used. However, the same surface resistance and the thickness were used for all conductive sheets 9K. The surface resistance and the thickness were 105Ω/□ and 0.1 mm, respectively. The material of the conductive sheets 9K was polytetrafluoroethylene (PTFE).

For the elastic portion 8K of the secondary charging member 10K, a sponge having the thickness of 5 mm was used. The secondary charging member 10K was pressed against the photoreceptor 3K such that the sponge was compressed to a certain thickness. The contact pressure between the conductive sheet 9K and the photoreceptor 3K was adjusted by adjusting the amount of the compression of the sponge.

In multiple test printings using the conductive sheets 9K of different material and pressure, an adhesion of toner on the surface of the conductive sheet 9K was examined and evaluated after printing was performed under the condition 2, and the conductive sheet 9K was removed from the process unit 1K.

When there was a toner adhering to the center of the conductive sheet 9K in the surface direction of movement of the photoreceptor, YES was indicated in Table 1. When there was no toner adhering to the conductive sheet 9K, NO was indicated in Table 1.

A wear amount of the conductive sheets 9K was measured based on a surface profile using a VK-9500 laser microscope manufactured by Keyence Corporation.

The result of the experiment is shown in Table 1.

TABLE 1

| CONTACT PRESSURE [kN/m$^2$] | CONDUCTIVE SHEET TENSILE STRENGTH AT BREAK [MPa] | TONER ADHERANCE | WEAR AMOUNT OF SHEET [μm] |
|---|---|---|---|
| 2 | 10 | YES | 2 |
| 4 | 7 | YES | 16 |

TABLE 1-continued

| CONTACT PRESSURE [kN/m$^2$] | CONDUCTIVE SHEET TENSILE STRENGTH AT BREAK [MPa] | TONER ADHERANCE | WEAR AMOUNT OF SHEET [μm] |
|---|---|---|---|
| 4 | 10 | NO | 8 |
| 9 | 30 | NO | 5 |
| 15 | 40 | NO | 5 |
| 4 | 40 | NO | 3 |
| 15 | 10 | NO | 10 |
| 17 | 40 | YES | 4 |
| 15 | 60 | YES | 2 |

As shown in TABLE 1, when the conductive sheet 9K had a tensile strength at break of at least 10 MPa and no more than 40 MPa, and was pressed against the photoreceptor 3K at a contact pressure of at least 4 kN/m$^2$ and no more than 15 kN/m$^2$, no adhesion of toner was observed.

The inventors of the present invention confirmed in other experiments that where toner accumulation was indicated as NO in TABLE 1, toner adhesion capable of causing image deterioration did not further occur even after the monochrome two-by-two halftone image was continuously printed on more than 10,000 sheets. In other words, toner accumulation relative to the conductive sheet 9K continues to be suppressed for an extended period of time.

When the tensile strength of the conductive sheet 9K at break was less than 10 MPa, the presence of toner on the conductive sheet 9K was confirmed near a downstream end portion thereof in the photoreceptor surface direction of movement even though the appropriate contact pressure, that is, the contact pressure between 4 and 15 kN/m$^2$, was applied. It was assumed that flexibility near the downstream end portion of the conductive sheet 9K caused rippling of the conductive sheet 9K.

Furthermore, when the tensile strength of the conductive sheet 9K at break was more than 40 MPa, toner adhesion was confirmed. This is because, as can be seen from the result of the measurement of the wear amount, the conductive sheet 9K was not sufficiently worn with friction with the photoreceptor 3K.

In other words, when the tensile strength of the conductive sheet 9K at break is between 10 and 40 MPa, the friction against the photoreceptor 3K causes the conductive sheet 9K to be sufficiently worn. Even if there is a slight adhesion of toner, the portion to which the toner adheres is soon worn away, and thus toner accumulation exceeding a tolerable range does not occur.

When the contact pressure was less than 4 kN/m$^2$, the conductive sheet 9K was not sufficiently worn due to an insufficient contact pressure even though the tensile strength of the conductive sheet 9K at break was appropriate, that is, between 10 and 40 MPa. Consequently, toner accumulation exceeding a tolerable range occurred.

Furthermore, when the contact pressure was more than 15 kN/m$^2$, the toner was pressed too hard against the conductive sheet 9K, and thus the toner fusion was enhanced, causing toner adhesion even though the tensile strength of the conductive sheet 9K at break was appropriate, that is, between 10 and 40 MPa. Consequently, toner accumulation exceeding a tolerable range occurred.

The image forming apparatus of the exemplary embodiment uses the conductive sheet having a tensile strength at break of at least 10 MPa, and no more than 40 MPa as the conductive sheet of the secondary charging member of the process units 1Y, 1M, 1C, and 1K. Furthermore, the conductive sheet is pressed against the photoreceptor with a contact pressure of at least 4 kN/m$^2$.

It should be noted that the above-described test printing used the secondary charging member including the conductive sheet pressed against the photoreceptor through the elastic portion.

However, according to other experiments performed by the inventors of the present invention, the same results as those shown in TABLE 1 were obtained when a conductive blade having similar if not identical properties as those of the conductive sheet was cantilevered against the photoreceptor.

The foregoing description is that of an example in which the direct current voltage is employed as the charging bias. Alternatively, however, an alternating current voltage superimposed on the direct current can be used.

Furthermore, a description is given above of an example in which the direct current voltage is employed as the secondary charging bias. Alternatively, however, an alternating current voltage superimposed on the direct current can be used.

It is preferable that a secondary charging nip width be 2 mm or more. The secondary charging nip is a contact width of the conductive sheet of the secondary charging member and the photoreceptor in the photoreceptor surface direction of movement. When the secondary charging nip width is gradually reduced below 2 mm, as shown in TABLE 2 strength of the charge of the photoreceptor immediately after passing through the area of contact where the photoreceptor and the conductive sheet come into contact starts to drop, thereby inducing a charging failure. In addition, the strength of the charge of the toner adhering to the photoreceptor surface immediately after passing through the area of contact also starts to drop.

In the experiment shown in TABLE 2, a secondary charging bias of −700 V was applied to the conductive sheet.

The surface potential of the photoreceptor immediately before advancing to the area of contact with the conductive sheet was measured using an electrostatic voltmeter (Trek Model 344, manufactured by Trek, Inc.) and found to be between 0 and −50 V.

The strength of the charge of the transfer residual toner adhering to the photoreceptor surface immediately before advancing to the area of contact was measured using a portable charge measuring device (Q/m analyzer Trek Model 210HS, Trek, Inc.) and found to be between 0 and 0.5-μC/g.

TABLE 2

| SECONDARY CAHRGING NIP WIDTH [mm] | SURFACE POTENTIAL OF PHOTORECEPTOR [−V] | CHARGE AMOUNT OF TONER [−μC/g] |
|---|---|---|
| 1 | 100 | 10 |
| 2 | 295 | 55 |
| 5 | 205 | 60 |
| 8 | 298 | 57 |

In the test printing shown in TABLE 1, the secondary charging nip was set to 5 mm. However, similar if not identical results as those shown in TABLE 1 can be obtained when the secondary charging nip is 2 mm and 8 mm.

TABLE 3

| SECONDARY CAHRGING NIP WIDTH [mm] | CONTACT PRESSURE [kN/m$^2$] | CONDUCTIVE SHEET TENSILE STRENGTH AT BREAK [MPa] | TONER ADHERANCE | WEAR AMOUNT OF SHEET [μm] |
|---|---|---|---|---|
| 2 | 4 | 10 | NO | 3 |
| 2 | 15 | 40 | NO | 2 |
| 8 | 4 | 10 | NO | 9 |
| 8 | 15 | 40 | NO | 5 |

Where the secondary charging of the photoreceptor is not needed, but the transfer residual toner needs to be charged, it is preferable that the secondary charging bias of between 300V and 500 V (absolute value) be applied to the conductive sheet.

The inventors of the present invention used different values for the secondary charging bias to apply to the conductive sheet and investigated generation of toner filming or toner accumulation relative to the photoreceptor by outputting test charts onto 20,000 recording sheets at different secondary charging biases.

The conditions of the experiment were as follows:

Secondary charging nip width in the photoreceptor surface direction of movement: 2 mm.

Secondary charging nip pressure: 4 kN/m$^2$.

Tensile strength of conductive sheet at break: 40 MPa.

Test chart: Image-area ratio was 50% on an A4-size recording sheet.

[Atmospheric Environment]

Room temperature: 23 degree C.

Humidity: 50%.

Number of charts output: 20,000 sheets.

The experiment was performed under the above-described conditions.

When the secondary charging bias was set between 300 V and 500 V as shown in TABLE 4, toner filming did not occur on the photoreceptor even after 20,000 sheets of the test charts were output.

TABLE 4

| SECONDARY CHARGING BIAS [V] | AFTER PASSING THROUGH SECONDARY CHARGING NIP: SURFACE POTENTIAL OF PHOTORECEPTOR [−V] | AFTER PASSING THROUGH SECONDARY CHARGING NIP: CHARGE AMOUNT OF TRANSFER RESIDUAL TONER [−μC/g] | TONER FILMING ON PHOTORECEPTOR AFTER PRINTING 20,000 SHEETS |
|---|---|---|---|
| 200 | 20 | 12 | NO |
| 300 | 42 | 51 | NO |
| 500 | 175 | 57 | NO |
| 600 | 296 | 52 | YES |
| 700 | 295 | 55 | YES |

As shown in TABLE 4, when the secondary charging bias was between 300 and 500 V, the photoreceptor was not sufficiently charged.

However, the transfer residual toner was adequately charged to a negative polarity which was the normal charging polarity. When the transfer residual toner is charged to 10-μC/g, contamination of the photoreceptor and the charging roller can be avoided.

Thus, where the secondary charging of the photoreceptor is not needed, when the secondary charging bias is set to an absolute value of between 300 V and 500 V, toner filming can be suppressed on the photoreceptor.

On the other hand, when the secondary charging bias is set to an absolute value of greater than 500 V, the photoreceptor can be adequately charged in the secondary charging nip.

However, because discharge is actively generated between the conductive sheet and the photoreceptor, the toner adheres to the photoreceptor surface, causing toner filming on the photoreceptor surface.

It is preferable that the thickness of the conductive sheet of the secondary charging member be between 50 μm and 2 mm. When the thickness is less than 50 μm, the durability needed for popular devices is difficult to attain.

Furthermore, when the thickness is more than 2 mm, the flexibility of the conductive sheet is insufficient, and thus the conductive sheet and the photoreceptor do not come into close contact.

It is preferable that a surface resistance of the conductive sheet of the conductive member of the secondary charging member be no less than $10^2$ Ω/cm$^2$ and no more than $10^8$ Ω/cm$^2$.

When the surface resistance is less than $10^2$ Ω/cm$^2$, the electric current flows relatively well between the conductive sheet and the photoreceptor. Consequently, discharge cannot be attained therebetween, and thus it is difficult to suppress uneven charging and contamination of the photoreceptor surface. When the surface resistance is more than $10^8$ Ω/cm$^2$, the discharge uniformity between the conductive sheet and the photoreceptor starts to deteriorate significantly. Consequently, it is difficult to suppress uneven charging.

It is preferable that a specific volume resistivity of the conductive sheet of the secondary charging member be no less than $10^2$ Ω·cm and no more than $10^6$ Ω·cm. In terms of the discharge uniformity, it is advantageous when the specific volume resistivity is less than the surface resistance.

When the specific volume resistivity is less than $10^2$ Ω·cm, the electric current flows relatively well between the conductive sheet and the photoreceptor. Consequently, discharge cannot be attained therebetween.

It is preferable that a surface roughness Ra, that is, a maximum variation in thickness or height, of the conductive sheet of the secondary charging member be no less than 0.1 μm and no more than 0.6 μm. When the surface roughness Ra is more than 0.6 μm, the toner is likely to rapidly accumulate, stick, and firmly adhere to any depressions, however slight, in the slightly irregular surface of the conductive sheet of the secondary charging member.

Conversely, when the surface roughness Ra is less than 0.1, contact failure with the photoreceptor occurs, and consequently, image contamination is likely to be generated rapidly.

It is preferable that a contact angle of pure water on the conductive sheet surface be no less than 105 degrees. When the contact angle of pure water is more than 105 degrees, toner build-up is likely to occur rapidly.

The contact angle of pure water can be measured by a droplet method using a contact angle measuring device Model CA-DT•A manufactured by Kyowa Interface Science Co., LTD in accordance with an operation manual of the contact angle measuring device.

It is preferable that the contact angle of pure water on the photoreceptor be no less than 90 degrees. When the contact angle of pure water on the photoreceptor is less than 90 degrees, toner accumulation relative to the photoreceptor is likely to occur rapidly.

It is preferable that toner particles of the toner include an external additive in an amount of from 1 to 4 parts by weight relative to the toner particles. When the toner of the exemplary embodiment advances to the area of contact between the conductive sheet of the secondary charging member and the photoreceptor, toner accumulation relative to the conductive sheet can be suppressed by providing the external additive between the toner particles and the conductive sheet.

When the amount of the external additive exceeds 4 parts by weight, the external additive may transfer to other devices, causing an adverse effect.

It is preferable that those toner particles having a particle diameter of no more than 5 μm constitute no more than 15% of all toner particles. When this ratio starts to exceed 15%, toner accumulation relative to the conductive sheet is likely to occur rapidly.

It is preferable that the photoreceptor having the surface roughness Ra of between 0.05 and 6 be used. When the surface roughness Ra starts to fall below 0.05, agglutinated toner masses start to easily leak and contaminate the image.

An agglutinated toner mass is formed when the toner, for example, the toner K for black, is blocked at the area of contact between the conductive sheet 9K and the photoreceptor 3K and accumulates at an entrance of the area of contact, thereby forming a toner mass.

When the toner mass grows to a certain size, the toner mass drops from the entrance of the area of contact due to gravity and advances to the primary transfer nip for black. Consequently, the toner mass directly or indirectly adheres to the recording sheet P through the intermediate transfer belt 61, thereby causing contamination of the image.

When the surface roughness starts to exceed 6, the external additive of the toner is likely to adhere to any slightly depressed portion of the photoreceptor surface. Consequently, the image starts to deteriorate rapidly.

Figure 3:
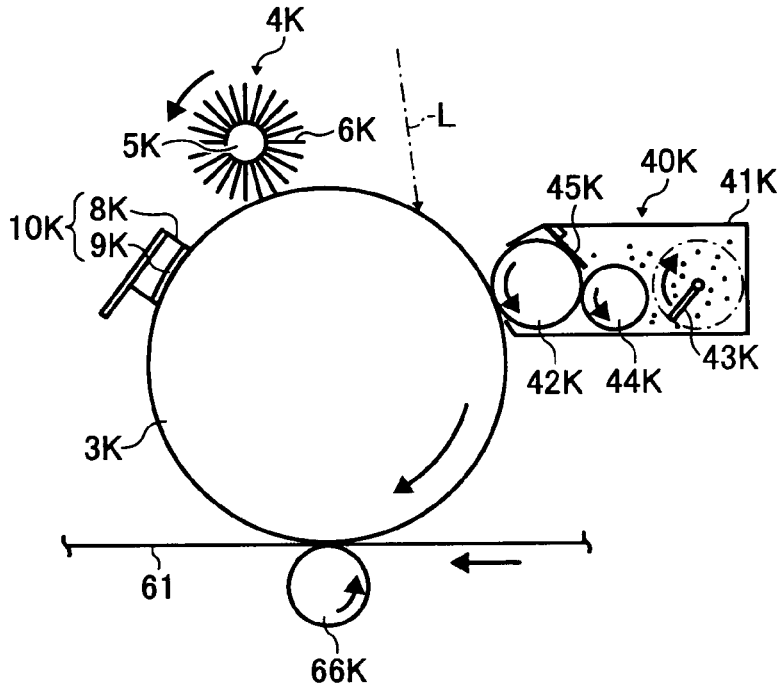
FIG. 3 is an enlarged view illustrating a process unit for black and an intermediate transfer belt according to an exemplary variation of the image forming apparatus.

Referring now to FIG. 3, there is provided a schematic diagram illustrating an exemplary variation of the image forming apparatus. According to the exemplary variation of the image forming apparatus, instead of the charging roller, a charging brush roller 4K is used as a charging member.

The charging brush roller 4K includes at least a metal rotary shaft member 5K and a plurality of brush fibers 6K. The rotary shaft member 5K is rotatively supported by a shaft bearing, not shown. The plurality of brush fibers 6K is provided to the surface of the rotary shaft member 5K in an erect manner.

While the charging brush roller 4K is rotatively driven in the counter-clockwise direction shown by an arrow with the rotary shaft member 5K in the center, the tips of the plurality of the brush fibers 6K brush the surface of the photoreceptor 3K.

A charging bias supply mechanism including a power source and electric wires, not shown, is connected to the metal rotary shaft member 5K. Accordingly, a charging bias consisting of a superimposed voltage, that is, a direct current voltage superimposed on an alternating current voltage, is applied to the metal rotary shaft member 5K.

At a charging nip where the plurality of the brush fibers 6K of the charging brush rollers 4K comes into contact with the photoreceptor 3K or in the vicinity of the charging nip, discharge is generated between each brush fiber 6K and the photoreceptor 3K. Accordingly, the surface of the photoreceptor 3K is uniformly charged to, for example, a negative polarity.

The exemplary variation of the image forming apparatus is of the temporary-capture cleanerless type. In particular, discharge is generated between the brush fibers 6K and the photoreceptor 3K in the charging nip so that the surface of the photoreceptor 3K is uniformly charged to the negative polarity.

In the meantime, the charging bias causes the transfer residual toner adhering to the photoreceptor 3K to transfer to the plurality of the brush fibers 6K so that the transfer residual toner is temporarily captured by the brush fibers 6K.

After completion of a print job or between printing each sheet, the charging bias is switched from the superimposed voltage to the direct current voltage so as to re-transfer the transfer residual toner captured by the brush fibers 6K onto the photoreceptor 3K. Subsequently, the transfer residual toner is recovered to the developing unit 40 from the photoreceptor 3K via the developing roller 42K.

Next, a description will be given of a second exemplary embodiment of the present invention. Unless otherwise specified, the structure of the image forming apparatus is similar to, if not the same as, that of the above-described exemplary embodiment.

Figure 4:
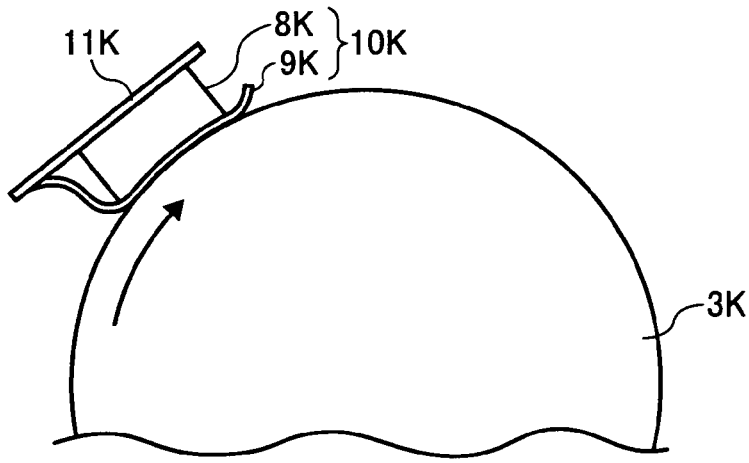
FIG. 4 is an enlarged view illustrating a secondary charging member of a process unit and a photoreceptor for black according to a second exemplary embodiment.

FIG. 4 is an enlarged view illustrating the secondary charging member 10K of the process unit for black and the photoreceptor 3K according to the second exemplary embodiment. In the image forming apparatus according to the second exemplary embodiment, the conductive sheet 9K of the second charging member is not fixed to the elastic portion 8K.

Instead, the conductive sheet 9K is cantilevered by a bearing member 11K. The conductive sheet 9K abuts the photoreceptor 3K such that the side of the conductive sheet 9K having a free end, that is, the side not being held by the bearing member 11K, faces downstream in the surface direction of movement of the photoreceptor. Accordingly, the conductive sheet 9K is pressed against the photoreceptor 3K by the elastic portion 8K.

According to the second exemplary embodiment, when the conductive sheet is rubbed and slid against the photoreceptor 3K, the conductive sheet 9K is pulled at the area of contact with the photoreceptor 3K. Accordingly, the conductive sheet 9K can be prevented from wrinkling, thereby eliminating uneven charging caused by wrinkles.

A description is now given of a third exemplary embodiment of the present invention.

According to the third exemplary embodiment, similar to the above-described the photoreceptors, photoreceptors 3Y, 3M, 3C, and 3K each serving as a latent image carrier having a cylindrical shape are used.

The elastic portion, for example, the elastic portion 8K of FIG. 2 that presses the conductive sheet against the photoreceptor, has an inwardly curved surface facing the photoreceptor. The inwardly curved surface is curved relatively inward from the both ends toward the center in the direction of movement of the photoreceptor.

Figure 5:
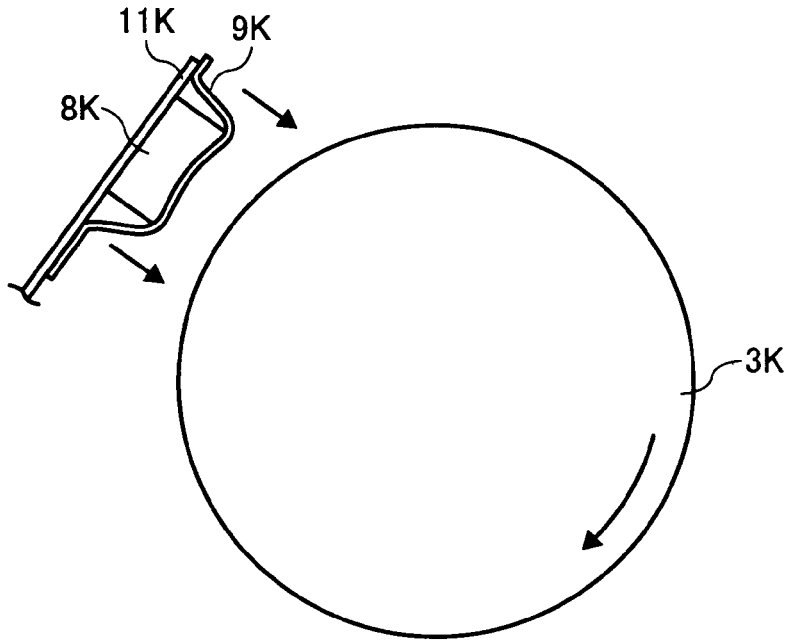
FIG. 5 is an enlarged view illustrating a conductive sheet for black and a peripheral structure thereof according to a third exemplary embodiment.

FIG. 5 is an enlarged view illustrating the conductive sheet 9K of the image forming apparatus and a peripheral structure according to the third exemplary embodiment. As shown in FIG. 5, the elastic portion 8K including an elastic member such as a sponge is fixed to the bearing member 11K, which bears the secondary charging member.

The surface of the elastic portion 8K facing the photoreceptor 3K has the substantially inwardly curved surface curved inward, with the same curvature as that of the photoreceptor so that the elastic portion 8K closely contacts the curved surface of the cylindrical photoreceptor 3K. The conductive sheet 9K adheres to the inwardly curved surface of the elastic portion 8K.

Figure 6:
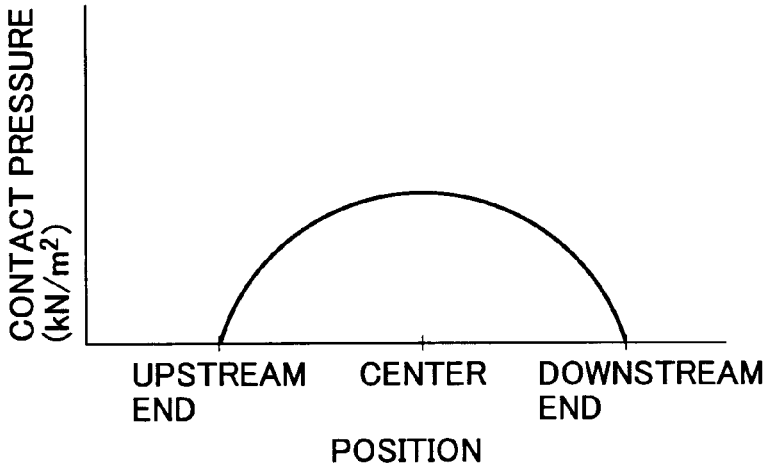
FIG. 6 is a graphical representation of a relation between a contact pressure between the photoreceptor and the conductive sheet, and a position of the conductive sheet according to the first exemplary embodiment.

FIG. 6 is a graphical representation illustrating a relation between the contact pressure of photoreceptor and the conductive sheet, and the position of the conductive sheet according to the first exemplary embodiment.

Figure 7:
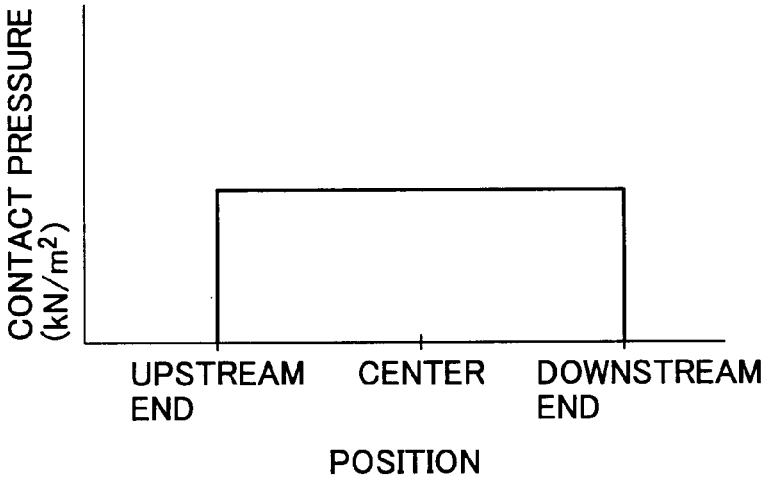
FIG. 7 is a graphical representation of a relation between a contact pressure between the photoreceptor and the conductive sheet, and a position of the conductive sheet according to the third exemplary embodiment.

FIG. 7 is a graphical representation illustrating a relation between the contact pressure of the photoreceptor and the conductive sheet, and the position of the conductive sheet according to the third exemplary embodiment.

As shown in FIG. 6, according to the first exemplary embodiment, the contact pressures between both the upstream and the downstream ends of the conductive sheet in the photoreceptor surface direction of movement and the photoreceptor are lower than at the center of the conductive sheet.

This is because the flat surface of the elastic portion is pressed against the outwardly curved surface of the photoreceptor, thereby causing an amount of the photoreceptor embedded into the center of the elastic portion to be greater than that of both ends.

On the other hand, as shown in FIG. 7, according to the third exemplary embodiment, the contact pressure with the photoreceptor is uniform from the upstream end to the downstream end of the conductive sheet.

This is because the embedded amount of the photoreceptor against the elastic portion is uniform throughout the area from the upstream end to the downstream end.

Thus, according to the third exemplary embodiment, the contact pressure of the entire area where the photoreceptor and the conductive sheet are in contact can be uniform.

Figure 8:
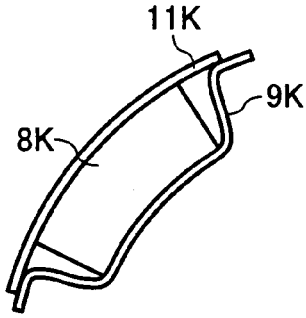
FIG. 8 is an enlarged view illustrating a secondary charging member for black of the image forming apparatus according to the third exemplary embodiment.

Referring now to FIG. 8, there is provided an enlarged view illustrating the secondary charging member according to an exemplary variation of the image forming apparatus of the third exemplary embodiment.

According to the exemplary variation, the elastic portion 8K itself has a substantially rectangular shape and does not include an inwardly curved surface. Instead, the bearing member 11K has an inwardly curved surface, and fixedly holds the elastic member 8K along its inwardly curved surface.

As a result, the surface of the elastic member 8K is curved, and the surface of the elastic portion 8K facing the photoreceptor is curved relatively inward.

According to the exemplary variation, a general-purpose elastic material having no inwardly curved surface is used as the elastic portion 8K so that the cost can be reduced. With a combination of the elastic portion 8K and the bearing member 11K, the surface of the elastic portion 8K facing the photoreceptor is deformed such that the surface is curved inward. Accordingly, uniformity of the contact pressure can be attained.

A description is now given of a fourth exemplary embodiment of the present invention.

According to a fourth exemplary embodiment, the process units of the image forming apparatus does not use the secondary charging member including the conductive sheet, the elastic portion and the holding member.

With respect with the secondary charging member, a secondary charging unit is detachably mounted in the image forming apparatus, separately from the process unit.

In the secondary charging unit K for black, for example, the elastic portion 8K, the conductive sheet 9K, and the bearing member 11K, which are similar to, if not the same as, that of the third exemplary embodiment, are provided to a casing, not shown.

The fourth exemplary embodiment described above enables the conductive sheet 9K to be replaced independently of the photoreceptor. Thus, it is possible to reduce running costs compared with replacing the conductive sheet 9K together with the photoreceptor.

A description is now given of a fifth exemplary embodiment of the present invention.

The image forming apparatus according to a fifth exemplary embodiment uses the secondary charging sheet fixed to the process unit of each color and detachably mounted in the image forming apparatus separately from the photoreceptor.

The fifth exemplary embodiment enables the conductive sheet to be replaced when replacing a process unit out of toner in the developing unit. Accordingly, the conductive sheet is periodically replaced as appropriate.

In addition, when the toner storage unit storing the toner to supply to the developing unit is detachably mounted in the image forming apparatus separately from the developing unit, it is preferable that the secondary charging member be fixedly mounted in the toner storage unit.

Figure 9:
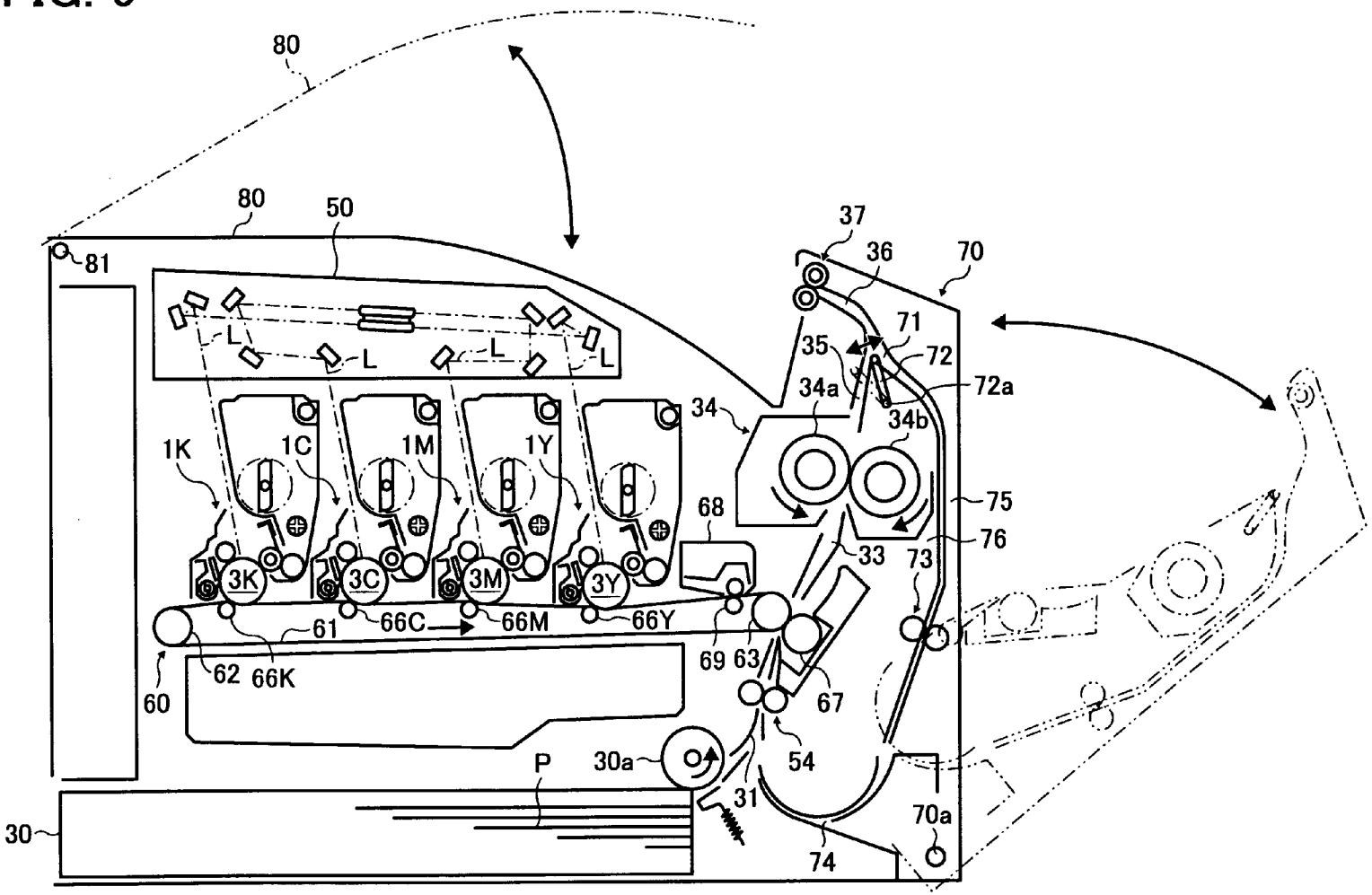
FIG. 9 is a schematic diagram illustrating an image forming apparatus according to a fifth exemplary embodiment.

FIG. 9 is a schematic diagram illustrating the image forming apparatus of the fifth exemplary embodiment. The image forming apparatus according to the fifth exemplary embodiment includes at least four process units 1Y, 1M, 1C, and 1K for forming toner images of yellow, magenta, cyan and black using respective colors of toner.

The structure of the process units are similar to, if not the same as, each other, except for the colors of toner. The process units 1Y, 1M, 1C, and 1K are replaced when reaching the end of their product life.

A description will be given of the process unit 1K for forming the toner image of black, as a representative example.

Figure 10:
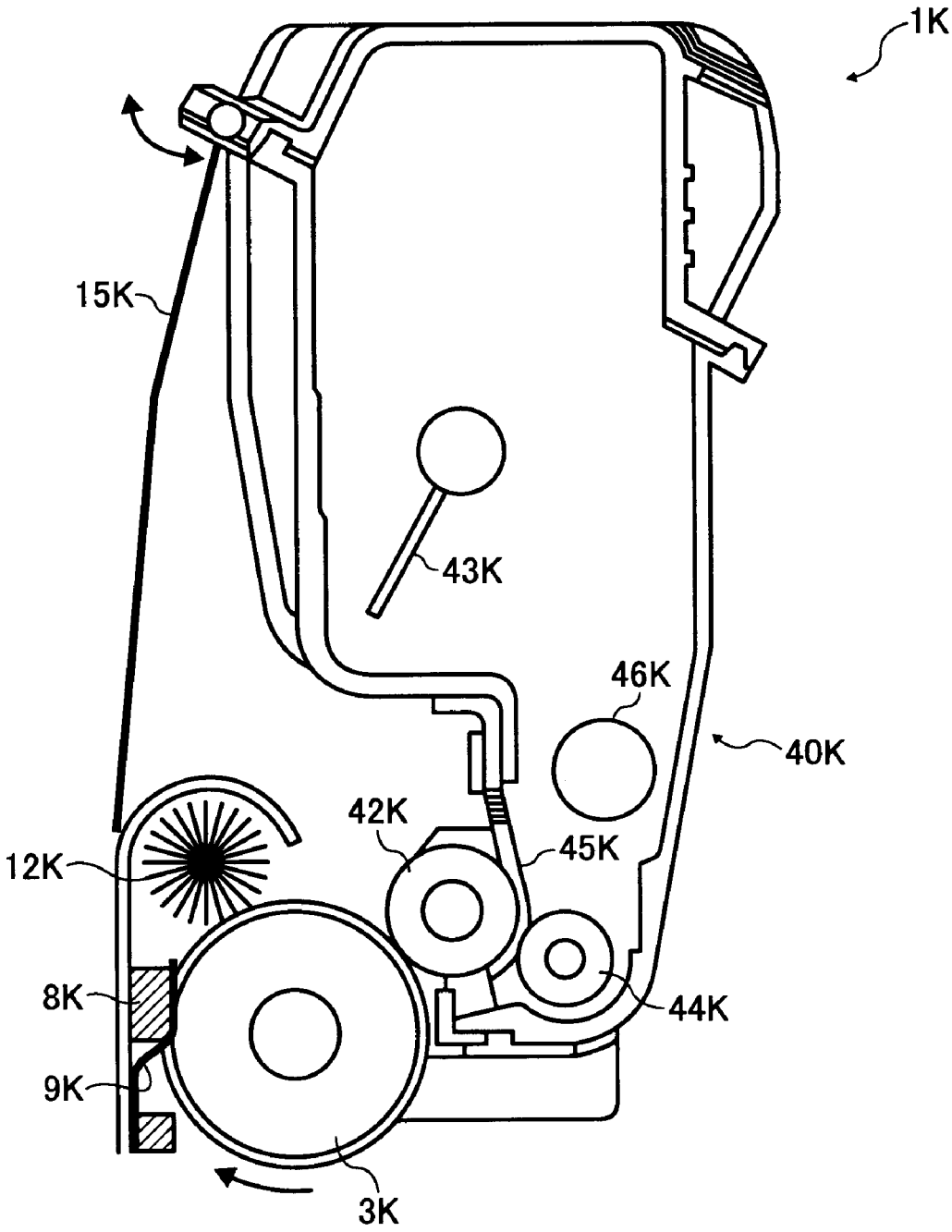
FIG. 10 is an enlarged view illustrating a process unit and a photoreceptor of the image forming apparatus of FIG. 9.

As shown in FIG. 10, the process unit 1K includes at least the developing unit 40K, the conductive sheet 9, the elastic member 8K that presses the conductive sheet 9K against the photoreceptor 3K, and a charging brush roller 12K.

The developing unit 40K, the conductive sheet 9, the elastic member 8K that presses the conductive sheet 9K against the photoreceptor 3K, and the charging brush roller 12K serving as the charging member and so forth, are held in a common casing and are integrally detachable from the image forming apparatus.

The photoreceptor 3K is held by a bearing member (not shown) separately from the process unit 1K. Accordingly, when the process unit 1K is removed from the image forming apparatus, the photoreceptor 3K stays inside.

While being rotatively driven in the counter-clockwise direction by a driving mechanism (not shown) in FIG. 10, the charging brush roller 12K abuts the photoreceptor 3K to uniformly charge the surface of the photoreceptor 3K. The uniformly charged surface of the photoreceptor 3K is exposed and scanned with a laser beam and bears an electrostatic latent image of black.

The developing unit 40K develops the electrostatic latent image of black into a toner image of black. Subsequently, the toner image of black is intermediately transferred to the intermediate transfer belt 61.

Similar to the process unit 1K, as shown in FIG. 9, in the process units 1Y, 1M, and 1C the toner images of yellow, magenta, and cyan, respectively, are formed on the photoreceptors 3Y, 3M, and 3C, respectively, and are intermediately transferred onto the intermediate transfer belt 61.

The developing unit 40K includes at least a vertically long hopper for storing the toner K and a developing portion (not shown).

In the hopper, there are provided an agitator 43K rotatively driven by a driving mechanism (not shown); an agitation paddle 46K rotatively driven by the driving mechanism (not shown) vertically below the agitator 43K; a toner supply roller 44K rotatively driven by a driving mechanism (not shown) vertically below the agitation paddle 46K; and so forth.

The agitator 43K and the agitation paddle 46K are rotatively driven and agitate the toner K in the hopper. The toner K is transferred to the toner supply roller 44K by its own weight.

The toner supply roller 44K includes at least a metal core and a roller portion made of a resin foam or the like that covers the metal core surface. The toner supply roller 44K attaches the toner K in the hopper to the surface of the roller portion while rotating.

In the developing portion of the developing unit 40K, there are provided a developing roller 42K, a blade 45K, and so forth. The toner developing roller 42K abuts the photoreceptor 3K and the toner supply roller 44K while rotating. The tip of blade 45K comes into contact with the surface of the developing roller 42K.

The toner K stuck to the toner supply roller 44K in the hopper is supplied to the surface of the developing roller 42K at a position where the developing roller 42K and the toner supply roller 44K come into contact with one another.

When passing through the contact position where the developing roller 42K and the blade 45K come into contact with each other along with the rotation of the developing roller 42K, the thickness of the supplied toner K on the roller surface is regulated. After the thickness is regulated, the toner K adheres to the electrostatic latent image of black on the surface of the photoreceptor 3K in the developing region where the developing roller 42K and the photoreceptor 3K come into contact.

With reference to FIG. 10, the foregoing description is given of the process unit 1K. Similar to the process unit 1K, in the process units 1Y, 1M and 1C shown in FIG. 9, the toner images of yellow, magenta, and cyan are formed on the photoreceptors 3Y, 3M and 3C, respectively.

In FIG. 9, the optical writing unit 50 is provided at a position vertically above the process units 1Y, 1M, 1C, and 1K. The optical writing unit 50 serving as a latent image writing mechanism optically scans the photoreceptors 3Y, 3M, 3C, and 3K of the process units 1Y, 1M, 1C, and 1K with the laser beams L emitted from the laser diodes based on the image information.

The electrostatic latent images of yellow, magenta, cyan, and black are formed on the photoreceptors 3Y, 3M, 3C, and 3K, respectively, by means of such optical scanning.

The optical writing unit 50 irradiates the photoreceptors with the laser beam L emitted from a light source such that the polygon mirror rotatively driven by a polygon motor (not shown) deflects the laser beam L emitted from the light source in a main scan direction, and the laser beam L is directed onto the photoreceptors through a plurality of optical lenses and mirrors.

It should be noted that an optical writing unit using LED light emitted from a plurality of LEDs of an LED array can be employed.

Vertically below the process units 1Y, 1M, 1C, and 1K there is provided the transfer unit 60 in which the endless intermediate transfer belt 61 moves in a continuous loop in the counter-clockwise direction while stretched over rollers.

In addition to the intermediate transfer belt 61, the transfer unit 60 serving as the transfer mechanism includes at least the driving roller 63; the driven roller 62; four primary transfer bias rollers 66Y, 66M, 66C and 66K; the secondary transfer bias roller 67; a belt cleaning unit 68; a back-up roller 69; and so forth.

The intermediate transfer belt 61 is spanned by the driving roller 63, the driven roller 62, the back-up roller 69, and four primary transfer bias rollers 66Y, 66M, 66C and 66K. The intermediate transfer belt 61 continuously moves in the counter-clockwise direction in accordance with a rotary force of the driving roller 63 rotatively driven in the counter-clockwise direction by the driving mechanism (not shown).

The continuously moving intermediate transfer belt 61 is nipped between the four primary transfer bias rollers 66Y, 66M, 66C and 66K, and the photoreceptors 3Y, 3M, 3C, and 3K. Accordingly, the primary transfer nips for yellow, magenta, cyan, and black are formed at a contact position where the front surface of the intermediate transfer belt 61 and the photoreceptors 3Y, 3M, 3C, and 3K come into contact.

Substantially vertically below the transfer unit 60, there is provided the sheet feed cassette 30, which stores a stack of recording sheets P. The sheet feed cassette 30 is slidably detachably mountable on the image forming apparatus.

A sheet feed roller 30*a* of the sheet feed cassette 30 touches the top sheet of the recording sheets P and is rotated in the counter-clockwise direction with a predetermined timing so that the recording sheet P is fed to a sheet feed path 31.

In the vicinity of the end of the sheet feed path 31 is provided a pair of registration rollers 54. Immediately after the pair of registration rollers 54 rollers nips the recording sheet P sent from the sheet feed cassette 30, the rotation of the pair of registration rollers is stopped.

Subsequently, in synchronization with the toner images of the four different colors on the intermediate transfer belt 61 in the secondary transfer nip, the pair of the registration rollers 54 resumes its rotation and feeds the recording sheet P to the secondary transfer nip.

A secondary transfer electrical field and the nip pressure cause the toner images of the four different colors on the intermediate transfer belt 61, which are in close contact with the recording sheet P in the secondary transfer nip, to secondarily transfer onto the recording sheet P. Accordingly, a full-color toner image is formed.

The recording sheet P on which the full-color toner image is formed passes through the secondary transfer nip. Subsequently, the recording sheet P is separated from the secondary transfer roller 67 and the intermediate transfer belt 61 by self stripping (separation due to a curvature), and is sent to the later-described fixing unit 34 by way of a post transfer conveyance path 33.

That transfer residual toner which has not been transferred to the recording sheet P adheres to the intermediate transfer belt 61 after passing through the secondary transfer nip. The transfer residual toner is cleaned off from the belt surface by the belt cleaner 68, which abuts the surface of the intermediate transfer belt 61.

The cleaning back-up roller 69 disposed inside the loop of the intermediate transfer belt 61 backs up belt cleaning performed by the belt cleaner 68 from the inside of the loop.

The fixing unit 34 includes at least a fixing roller 34*a* and a pressure roller 34*b*. The fixing roller 34*a* includes a heat source such as a halogen lamp (not shown). The pressure roller 34*b* rotates and presses the fixing roller 34*a* at a predetermined pressure, thereby forming the fixing nip therebetween.

The recording sheet P sent to the fixing unit 34 is nipped by the fixing nip such that the surface which bears an unfixed toner image closely contacts the fixing roller 34*a*. Accordingly, the heat and the pressure cause the toner in the toner image to be softened. Accordingly, the full-color image on the recording sheet P is fixed.

After passing through a post-fixing conveyance path 35 the rerecording sheet P discharged from the fixing unit 34 approaches a branching point between a sheet discharge path 36 and a pre-reverse conveyance path 71.

On the side of the post-fixing conveyance path 35 is provided a switching pawl 72 which is rotatively driven around a rotary shaft 72*a*. According to its rotary movement, the area near the end portion of the post-fixing conveyance path 35 is closed and opened.

When the recording sheet P is fed from the fixing unit 34, the switching pawl 72 stops at a position indicated by a dotted line in FIG. 9 so as to open the area near the end portion of the post-fixing conveyance path 35.

Accordingly, the recording sheet P advances inside the sheet discharge path 36 from the post-fixing conveyance path 35 and is nipped between a pair of sheet discharge rollers 37.

When a single-side printing mode is set based on an input operation from a control portion consisting of a numeric pad or the like (not shown), and/or control signals transmitted from a personal computer or the like (not shown), the recording sheet P nipped between the pair of the sheet discharge rollers 37 is discharged from the image forming apparatus and stacked on a stack portion on an upper surface of an upper cover 80 of the image forming apparatus.

In a case of a two-sided printing mode, while the tip of the recording sheet P is nipped between the pair of the sheet discharge rollers 37, the recording sheet P is transported in the sheet discharge path 36. After the trailing edge of the recording sheet P passes through the post-fixing conveyance path 35, the separation pawl 72 turns until it reaches the position shown by a dotted line so that the area near the end of the post-fixing conveyance path 35 is closed.

Substantially at the same time, the pair of the sheet discharge rollers 37 starts to reversely rotate. Accordingly, the trailing edge of the recording sheet P is led to the front and is transported to the pre-reverse conveyance path 71.

The side of the image forming apparatus includes a reverse unit 70 which can be opened relative to the image forming apparatus main body by rotating it around the rotary shaft 70*a*.

When the pair of the sheet discharge rollers 37 rotates in reverse, the recording sheet P advances to the pre-reverse conveyance path 71 of the reverse unit 70, and is vertically transported from the upper side to the lower side.

After passing between a pair of reverse conveyance rollers 73, the recording sheet P advances to a semicircular reverse conveyance path 74. Furthermore, along its curved shape the recording sheet P is transported and reversed upside down. The direction of movement from the vertically upper side to the lower side is reversed. Accordingly, the recording sheet P is transported vertically from the lower side to the upper side.

Subsequently, the recording sheet P passes through the sheet feed path 31 and advances to the secondary transfer nip again. After the full-color image is secondarily transferred to the other side, the recording sheet P sequentially passes through the post-transfer conveyance path 33, the fixing unit 34, the post-fixing conveyance path 35, the sheet discharge path 36, and the pair of the sheet discharge rollers 37, and is discharged from the image forming apparatus.

The reverse unit 70 includes at least an external cover 75 and a swing member 76. Specifically, the external cover 75 of the reverse unit 70 is held such that the cover turns around the rotary shaft 70*a* provided to the image forming apparatus. According to its rotation, the external cover 75 opens and closes with the swing member 76 held inside thereof relative to the image forming apparatus main body.

As shown by the dotted line in FIG. 9, when the external cover 75 opens with the swing member 76, the sheet feed path 31 formed between the reverse unit 70 and the image forming apparatus main body, the secondary transfer nip, the post-transfer conveyance path 33, the fixing nip, the post-fixing conveyance path 35 and the sheet discharge path 36 are vertically separated into two, and are exposed outside.

Accordingly, a jammed paper in the sheet feed path 31, the secondary transfer nip, the post-transfer conveyance path 33, the fixing nip, the post-fixing conveyance path 35 and the sheet discharge path 36 can easily be removed.

The swing member 76 is held by the external cover 75 such that the swing member 76 turns around the swing shaft (not shown) provided to the external cover 75 in a state in which the external cover 75 is opened.

Therefore, when the swing member 76 is opened relative to the external cover 75, the pre-reverse conveyance path 71 and the reverse conveyance path 74 are vertically separated into two and exposed outside.

Accordingly, a jammed paper in the pre-reverse conveyance path 71 and the reverse conveyance path 74 can easily be removed.

The upper cover 80 of the image forming apparatus is held such that the upper cover 80 can be turned around the shaft member 81. When being turned in the counter-clockwise direction, the upper cover 80 opens relative to the image forming apparatus main body, thereby exposing the upper portion of the image forming apparatus main body by a large amount.

In the image forming apparatus of the exemplary embodiments, the process units 1Y, 1M, 1C, and 1K are disposed above the intermediate transfer belt 61. Further above is provided the optical writing unit 50. Therefore, when installing the optical writing unit 50 in the image forming apparatus main body or removing the optical writing unit 50 from the image forming apparatus main body, the optical writing unit 50 needs to be retracted from the process units 1Y, 1M, 1C, and 1K.

Figure 11:
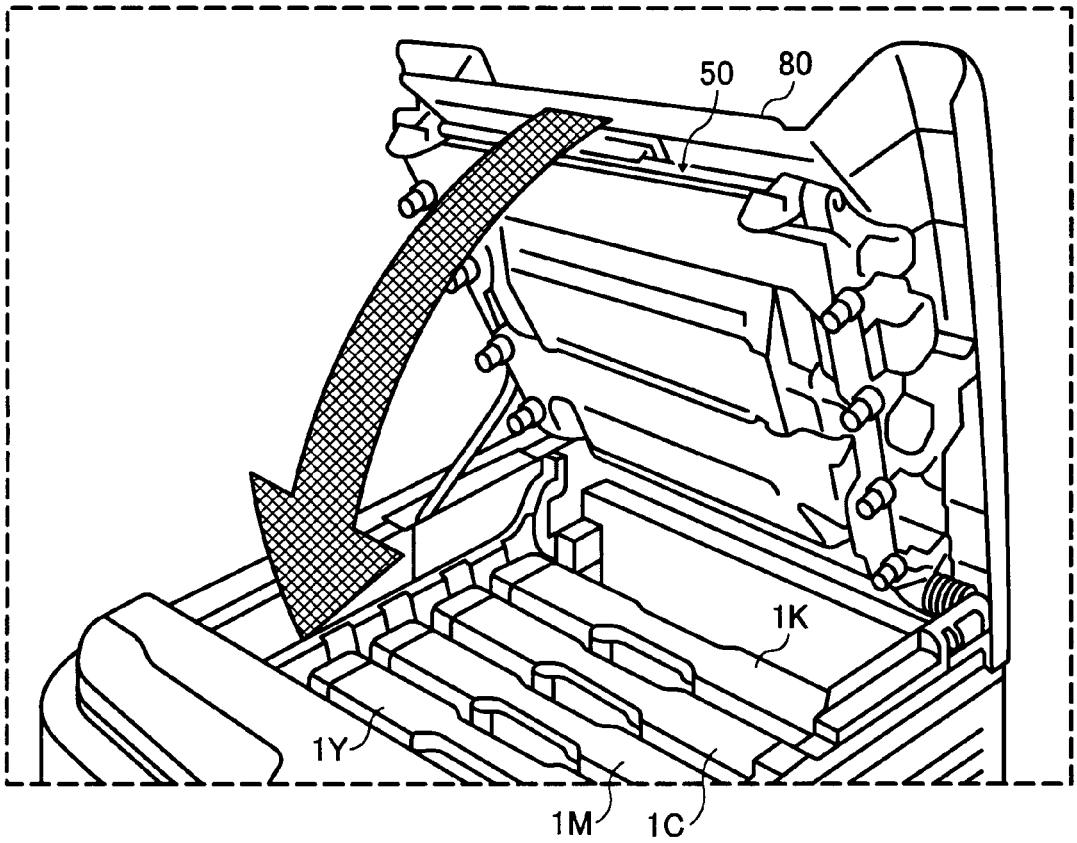
FIG. 11 is a partial enlarged view illustrating the image forming apparatus when a cover thereof is opened as viewed obliquely from above.

Thus, as shown in FIG. 11, the optical writing unit 50 is held by the bottom surface of the upper cover 80 so that the optical unit 50 can be retracted from the process units 1Y, 1M, 1C, and 1K when the upper cover 80 is opened.

Figure 12:
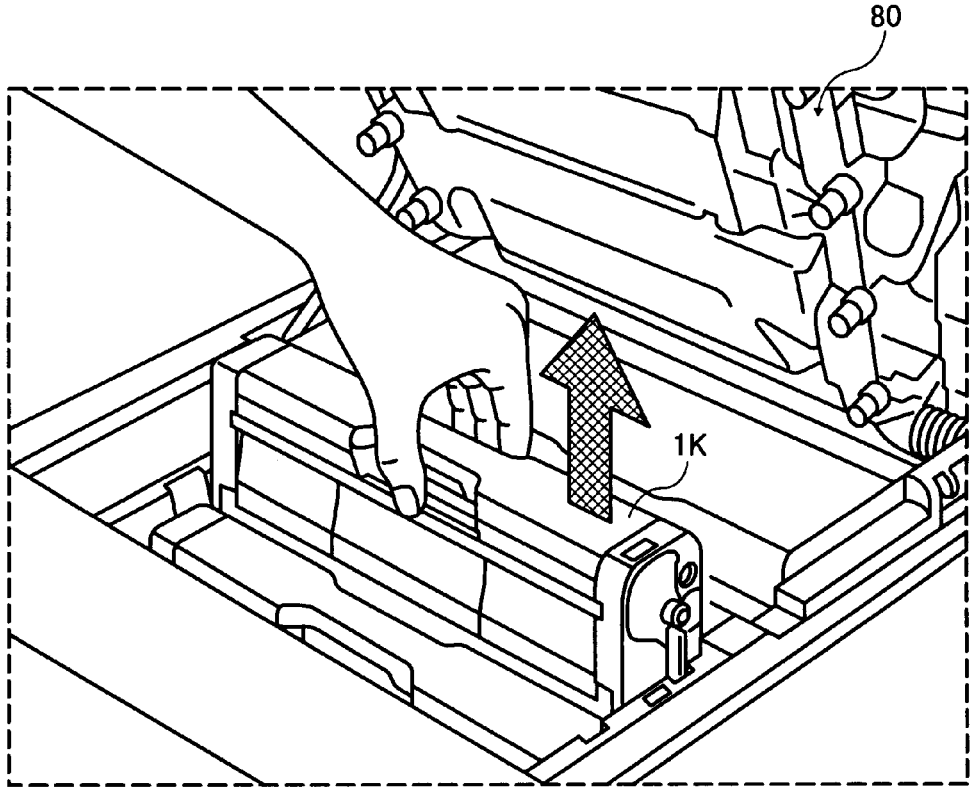
FIG. 12 is a partial enlarged view illustrating the image forming apparatus when the process unit for black is taken out of the image forming apparatus as viewed from obliquely from above.

As shown in FIG. 12, when the upper cover 80 is opened, the process units 1Y, 1M, 1C, and 1K are exposed from an opening for maintenance provided to the image forming apparatus upper end so that the process units 1Y, 1M, 1C, and 1K can be held. Accordingly, the process units 1Y, 1M, 1C, and 1K can be pulled out vertically upward from the image forming apparatus main body.

Figure 13:
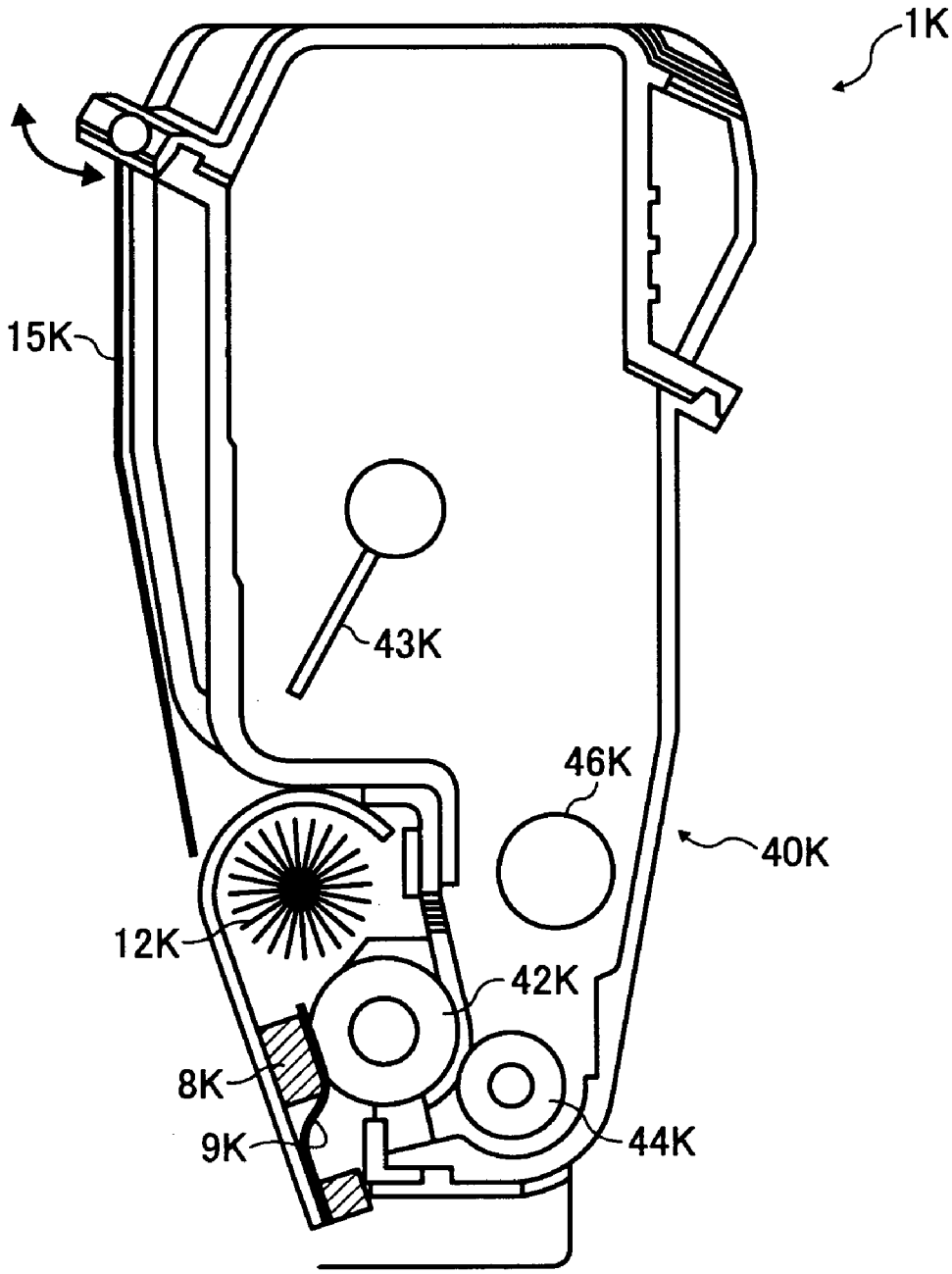
FIG. 13 is an enlarged view illustrating the process unit being taken out of the image forming apparatus.

Referring now to FIG. 13, there is provided an enlarged view illustrating the process unit 1K after being pulled out from the image forming apparatus.

In FIG. 13, the process unit 1K includes at least a swing bracket 15K swingably held by the casing of the developing unit 40. The swing bracket 15K supports the charging brush roller 12K, the conductive sheet 9K and the elastic portion 8K.

As previously shown in FIG. 10, when the process unit 1K is installed in the image forming apparatus, the photoreceptor 3K is positioned between the charging brush roller 12K contacting the photoreceptor 3K and the developing roller 42K. When the process unit 1K is removed from the image forming apparatus, the photoreceptor 3K is retracted from the position between the charging brush roller 12K and the developing roller 42K.

Consequently, the swing bracket 15K biased toward the developing roller 42 by a spring (not shown) turns slightly in the counter-clockwise direction around the swing shaft. Subsequently, as shown in FIG. 13, the swing bracket 15K moves to the right in FIG. 13 by a substantially same amount as the size of the photoreceptor 3K. Accordingly, the size of the process unit 1K is reduced.

When the process unit 1K is installed in the image forming apparatus, the photoreceptor 3K moves into the space between the free end of the swing bracket 15K and the developing roller 42K, and the swing bracket swings open.

Accordingly, as shown in FIG. 10, the photoreceptor 3K is positioned between the charging brush roller 12K on the swing bracket 15K and the developing roller 42K.

Figure 14:
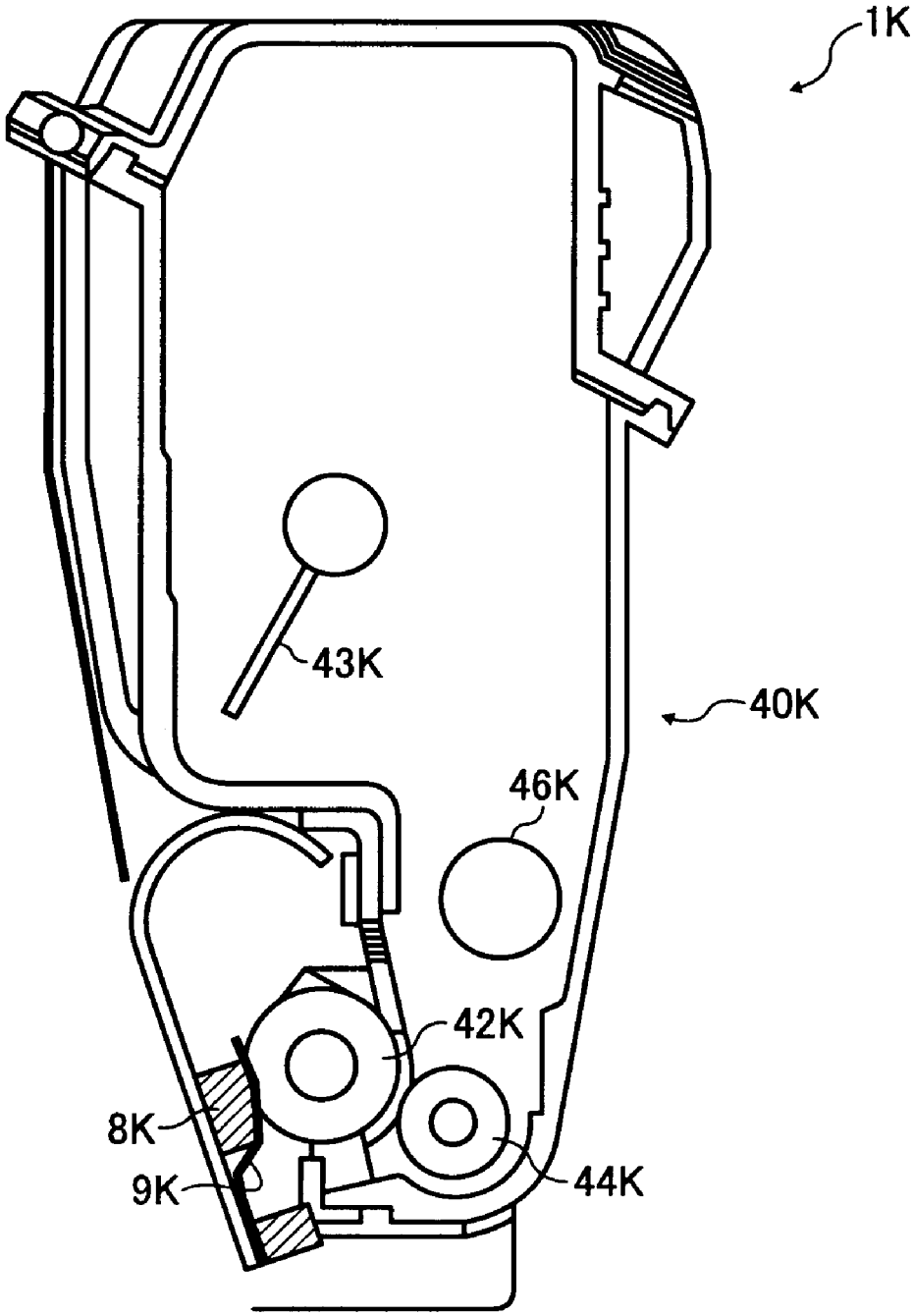
FIG. 14 is an enlarged view illustrating the process unit according to the fifth exemplary embodiment.

Referring now to FIG. 14, there is provided an enlarged view illustrating the process unit 1K according to the fifth exemplary embodiment.

According to the fifth exemplary embodiment, not only the photoreceptor 3K, but also the charging brush roller is detachably mounted in the image forming apparatus such that the charging brush roller can be detached from the image forming apparatus independently of the process unit 1K.

When the process unit 1K is removed from the image forming apparatus, the charging brush roller and the photoreceptor are retracted from the process unit 1K.

The foregoing description is given of the image forming apparatus using the process unit of the cleanerless type. However, the present invention can be applied to a structure with a cleaning mechanism which removes the transfer residual toner from the photoreceptor surface before advancing to the charging nip after passing through the first transfer nip.

Further, elements and/or features of different exemplary embodiments may be combined with each other and/or substituted for each other within the scope of this disclosure and appended claims.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. An image forming apparatus, comprising:

a latent image carrier configured to bear a latent image;

a latent image forming mechanism configured to form the latent image on the latent image carrier;

a developing mechanism configured to develop the latent image on the latent image carrier with toner into a toner image; and a charger including a conductive member supplied with a bias voltage while contacting a surface of the latent image carrier, configured to charge at least one of the surface of the latent image carrier and a toner adhering to the surface thereof through the conductive member, wherein a tensile strength of the conductive member at break is no less than 10 MPa and no more than 40 MPa, and a contact pressure between the conductive member and the latent image carrier is no less than 4 $kN/m^2$ and no more than 15 $kN/m^2$.

2. The image forming apparatus according to claim 1, wherein a width of a contact between the latent image carrier and the conductive member is no less than 2 mm in a surface direction of movement of the latent image carrier.

3. The image forming apparatus according to claim 1, further comprising a bias supply mechanism configured to supply a bias voltage of no less than 300 V and no more than 500 V (absolute value) to the conductive member.

4. The image forming apparatus according to claim 1, wherein a surface resistance of the conductive member is no less than $10^2$ $\Omega/cm^2$ and no more than $10^8$ $\Omega/cm^2$.

5. The image forming apparatus according to claim 1, wherein a specific volume resistivity of the conductive member is no less than $10^2$ $\Omega\cdot cm$ and no more than $10^6$ $\Omega\cdot cm$.

6. The image forming apparatus according to claim 1, wherein a contact angle of pure water on the conductive member surface is no less than 105 degrees.

7. The image forming apparatus according to claim 1, wherein the conductive member comprises a conductive sheet configured to be cantilevered by a bearing member and include a fixed end held by the bearing member and a free end, the conductive sheet configured to contact the latent image carrier such that the free end faces further downstream than the fixed end in the latent image carrier surface direction of movement.

8. The image forming apparatus according to claim 1, further comprising:

an elastic member configured to press the conductive member against the latent image carrier, including a surface facing the latent image carrier that is substantially curved inward from both ends thereof in the surface direction of movement of the latent image carrier, wherein the latent image carrier has a cylindrical shape.

9. The image forming apparatus according to claim 7, wherein the bearing member has an inwardly curved surface, and the elastic member is fixed thereto.

10. The image forming apparatus according to claim 7, further comprising a holder configured to hold the conductive member and the bearing member as one unit, detachably mountable in the image forming apparatus separately from the latent image carrier.

11. The image forming apparatus according to claim 1, further comprises a toner storage unit configured to store toner to supply to the developing mechanism, wherein the conductive member is fixedly mountable on at least one of the developing mechanism and the toner storage unit and detachably mountable in the image forming apparatus.

12. A process unit, comprising:

a holder configured to hold at least one of a latent image carrier and a charger, detachably mountable in an image forming apparatus, the image forming apparatus comprising:

a latent image carrier configured to bear a latent image;

a latent image forming mechanism configured to form the latent image on the latent image carrier;

a developing mechanism configured to develop the latent image on the latent image carrier with toner into a toner image; and a charger including a conductive member supplied with a bias voltage while contacting a surface of the latent image carrier, configured to charge at least one of the surface of the latent image carrier and a toner adhering to the surface thereof through the conductive member, wherein a tensile strength of the conductive member at break is no less than 10 MPa and no more than 40 MPa, and a contact pressure between the conductive member and the latent image carrier is no less than 4 $kN/m^2$ and no more than 15 $kN/m^2$.

13. An image forming apparatus, comprising:

means for bearing a latent image;

means for forming the latent image on the latent image carrier;

means for developing the latent image on the latent image carrier with toner into a toner image; and means for charging at least the surface of the latent image carrier and a toner adhering to the surface thereof through the conductive member, including a conductive member supplied with a bias while contacting a surface of the latent image carrier, wherein a tensile strength of the conductive member at break is no less than 10 MPa and no more than 40 MPa, and a contact pressure between the conductive member and the latent image carrier is no less than 4 $kN/m^2$ and no more than 15 $kN/m^2$.

* * * * *